US007681643B2

(12) United States Patent
Heins

(10) Patent No.: US 7,681,643 B2
(45) **Date of Patent: *Mar. 23, 2010**

(54) TREATMENT OF BRINES FOR DEEP WELL INJECTION

(75) Inventor: William F. Heins, Redmond, WA (US)

(73) Assignee: GE Ionics, Inc., Trevose, PA (US)

( * ) Notice: Subject to any disclaimer, the term of this patent is extended or adjusted under 35 U.S.C. 154(b) by 453 days.

This patent is subject to a terminal disclaimer.

(21) Appl. No.: 11/534,627

(22) Filed: Sep. 22, 2006

(65) Prior Publication Data

US 2007/0051513 A1 Mar. 8, 2007

Related U.S. Application Data

(63) Continuation-in-part of application No. 11/149,072, filed on Jun. 8, 2005, now Pat. No. 7,438,129.

(60) Provisional application No. 60/578,810, filed on Jun. 9, 2004.

(51) Int. Cl.

| | |
|---|---|
| ***E21B 43/24*** | (2006.01) |
| ***E21B 43/40*** | (2006.01) |
| ***B01B 1/28*** | (2006.01) |
| ***B01D 3/42*** | (2006.01) |
| ***C02F 1/04*** | (2006.01) |
| ***C02F 9/00*** | (2006.01) |

(52) U.S. Cl. ..... 166/266; 159/24.1; 159/45; 159/471; 159/901; 166/267; 166/272.3; 166/303; 203/10; 203/26; 203/48; 203/98; 210/712; 210/714; 210/718; 210/737

(58) Field of Classification Search ..... None
See application file for complete search history.

(56) References Cited

U.S. PATENT DOCUMENTS 896,272 A 8/1908 Camors (Continued)

FOREIGN PATENT DOCUMENTS

CA 1166531 5/1984

(Continued)

OTHER PUBLICATIONS

News Release Transmitted by Canadian Corporate News For: Aqua Pure Ventures, Inc., Oct. 14, 1998, CCN Home Page site Map, Mar. 3, 1999, (2 pages).

(Continued)

*Primary Examiner*—George Suchfield
(74) *Attorney, Agent, or Firm*—R. Reams Goodloe, Jr.

(57) ABSTRACT

A process for conditioning of wastewater treatment brines for deep well injection during recovery of heavy hydrocarbon oils in situ. High pressure steam is used to mobilize oil, which is recovered in a mixture of oil and produced water. The produced water is pre-treated by removing residual oil. The remaining water is acidified and steam stripped to remove non-hydroxide alkalinity and non-condensable gases, and is then fed to a crystallizing evaporator, where it is evaporated from a circulating brine slurry to produce (1) a distillate stream having a trace amount of residual solutes, and (2) evaporator blowdown stream containing, as dissolved or suspended solids, substantially all of the solutes from the produced water feed. The distillate stream is used as boiler feedwater, either directly or after polishing. The evaporator blowdown is conditioned to remove substantially all suspended solids and to produce a clear brine solution for deep well injection.

50 Claims, 8 Drawing Sheets

U.S. PATENT DOCUMENTS

| | | | | |
|---|---|---|---|---|
| 1,399,845 | A | | 12/1921 | Bull |
| 2,091,898 | A | | 8/1937 | Weber |
| 2,979,442 | A | | 4/1961 | Badger |
| 3,026,261 | A | | 3/1962 | Mayfield et al. |
| 3,192,130 | A | | 6/1965 | Pottharst, Jr. |
| 3,193,009 | A | | 7/1965 | Wallace et al. |
| 3,340,159 | A | | 9/1967 | Tidball et al. |
| 3,353,593 | A | | 11/1967 | Boberg |
| 3,377,273 | A | | 4/1968 | Glueckauf |
| 3,399,975 | A | | 9/1968 | Otten |
| 3,401,094 | A | | 9/1968 | Lindsay, Jr. |
| 3,410,345 | A | | 11/1968 | Fradkin |
| 3,410,796 | A | | 11/1968 | Hull |
| 3,414,507 | A | | 12/1968 | Calmon |
| 3,476,183 | A | | 11/1969 | Haynes, Jr. et al. |
| 3,514,376 | A | | 5/1970 | Salutsky |
| 3,525,675 | A | | 8/1970 | Gaudin |
| 3,586,090 | A | | 6/1971 | Henderson |
| 3,714,985 | A | | 2/1973 | Bayless |
| 3,725,268 | A | | 4/1973 | Gelblum |
| 3,768,558 | A | | 10/1973 | Allen et al. |
| 3,891,394 | A | | 6/1975 | Smith et al. |
| 3,917,526 | A | | 11/1975 | Jennings |
| 3,926,739 | A | | 12/1975 | Izumi |
| 3,933,576 | A | | 1/1976 | Rushton |
| 3,951,752 | A | | 4/1976 | Roller |
| 3,951,753 | A | | 4/1976 | Roller |
| 3,963,619 | A | | 6/1976 | Caillaud et al. |
| 3,968,002 | A | | 7/1976 | Standiford |
| 3,974,039 | A | | 8/1976 | Frohner et al. |
| 4,030,985 | A | | 6/1977 | Barba et al. |
| 4,054,493 | A | | 10/1977 | Roller |
| 4,073,644 | A | | 2/1978 | Papafingos et al. |
| 4,083,781 | A | | 4/1978 | Conger |
| 4,090,916 | A | | 5/1978 | Papafingos et al. |
| 4,105,556 | A | | 8/1978 | D'Amaddio et al. |
| 4,119,149 | A | | 10/1978 | Wu et al. |
| 4,260,461 | A | | 4/1981 | Pottharst |
| 4,343,691 | A | | 8/1982 | Minkkinen |
| 4,344,826 | A | | 8/1982 | Smith |
| 4,370,858 | A | | 2/1983 | Awerbuch et al. |
| 4,391,102 | A | | 7/1983 | Studhalter et al. |
| 4,392,959 | A | | 7/1983 | Coillet |
| 4,398,603 | A | | 8/1983 | Rodwell |
| 4,444,680 | A | | 4/1984 | Kitzes et al. |
| 4,458,520 | A | | 7/1984 | Adame et al. |
| 4,472,355 | A | | 9/1984 | Hickam et al. |
| 4,474,011 | A | | 10/1984 | Nelson et al. |
| 4,475,595 | A | | 10/1984 | Watkins et al. |
| 4,548,257 | A | | 10/1985 | Williamson |
| 4,561,965 | A | | 12/1985 | Minkkinen |
| 4,576,627 | A | | 3/1986 | Hughes |
| 4,594,131 | A | | 6/1986 | Maier |
| 4,618,429 | A | * | 10/1986 | Herrigel ..... 210/652 |
| 4,698,136 | A | | 10/1987 | El-Allawy |
| 4,706,749 | A | | 11/1987 | Hayes et al. |
| 4,877,536 | A | | 10/1989 | Bertness et al. |
| 4,913,236 | A | | 4/1990 | Reed |
| 4,967,837 | A | | 11/1990 | Danzik |
| 5,250,151 | A | | 10/1993 | Huercanos |
| 5,250,185 | A | | 10/1993 | Tao et al. |
| 5,474,653 | A | | 12/1995 | Bostjancic |
| 5,587,054 | A | | 12/1996 | Keith |
| 5,681,476 | A | | 10/1997 | Grund et al. |
| 5,683,587 | A | | 11/1997 | Ferrara et al. |
| 5,695,643 | A | | 12/1997 | Brandt et al. |
| 5,783,084 | A | | 7/1998 | Suenkonis |
| 5,858,177 | A | | 1/1999 | Morris |
| 5,925,255 | A | | 7/1999 | Mukhopadhyay |
| 5,932,074 | A | | 8/1999 | Hoiss |
| 5,968,312 | A | | 10/1999 | Sephton |
| 6,074,549 | A | | 6/2000 | Bacon Cochrane et al. |
| 6,186,232 | B1 | | 2/2001 | Isaacs et al. |
| 6,205,289 | B1 | | 3/2001 | Kobro |
| 6,355,145 | B1 | | 3/2002 | Kresnyak et al. |
| 6,365,005 | B1 | | 4/2002 | Schleiffarth |
| 6,375,803 | B1 | | 4/2002 | Razzaghi et al. |
| 6,536,523 | B1 | | 3/2003 | Kresnyak et al. |
| 6,733,636 | B1 | | 5/2004 | Heins |
| 6,849,155 | B2 | | 2/2005 | Akita et al. |
| 6,929,753 | B1 | | 8/2005 | Falcon |
| 6,949,192 | B2 | | 9/2005 | Gsell |
| 6,960,301 | B2 | | 11/2005 | Bradley |
| 6,984,292 | B2 | | 1/2006 | Kresnyak et al. |
| 7,077,201 | B2 | * | 7/2006 | Heins ..... 166/266 |
| 7,150,320 | B2 | * | 12/2006 | Heins ..... 166/266 |
| 7,438,129 | B2 | * | 10/2008 | Heins ..... 166/266 |
| 2003/0127226 | A1 | | 7/2003 | Heins |
| 2003/0127400 | A1 | | 7/2003 | Kresnyak et al. |
| 2005/0022989 | A1 | | 2/2005 | Heins |
| 2005/0279500 | A1 | | 12/2005 | Heins |
| 2006/0032630 | A1 | | 2/2006 | Heins |
| 2008/0099154 | A1 | * | 5/2008 | Minnich et al. ..... 159/47.3 |

FOREIGN PATENT DOCUMENTS

| | | | |
|---|---|---|---|
| CA | 2274258 | | 7/1998 |
| CA | 2305118 | | 5/2000 |
| CA | 2345595 | | 11/2001 |
| CA | 2305118 | | 3/2002 |
| EP | 0916622 | B1 | 7/2002 |
| GB | 935178 | | 8/1963 |
| SU | 632655 | | 11/1978 |
| WO | WO98/31445 | | 7/1998 |
| WO | WO2004/035479 | A1 | 4/2004 |
| WO | WO2005/054746 | A2 | 6/2005 |

OTHER PUBLICATIONS

The Aqua Pure System: Pure Water Recovery, (Web Page); http:/www.aqua-pure.com, Mar. 3, 1999, (5 pages).

Becker, R.F. (Bob);Kresnyak, Steve; A Unique Mechanical Vapour Recompression / Distillation Process for Purifying Water, Colt Engineering Corporation, Calgary, Alberta, Canada, Mar. 3, 1999, (9 pages).

Heins, W., Achieving Zero Liquid Discharge in the Heavy Oil Recovery Industry. Oil Sands Process Water Workshop, May 8, 2001, Fort McMurray, Alberta.

Heins, W., and Schooley, K., Achieving Zero Liquid Discharge in SAGD Heavy Oil Recovery, Petroleum Society's Canadian International Petroleum Conference 2002; Calgary, Alberta, Jun. 11-13, 2002. (10 pages).

Heins, W., and Schooley, K., Achieving Zero Liquid Discharge in SAGD Heavy Oil Recovery, Journal of Canadian Petroleum Technology, Aug. 2004 vol. 43, No. 8. (pp. 37-42).

Heins, W., Peterson, D., Use of Evaporation for Heavy Oil Produced Water Treatment, Ionics RCC. Canadian International Petroleum Conference, Paper No. 2003-178 ("This paper is to be presented at the Petroleum Society's Canadian International Petroleum Conference 2003, Calgary, Alberta, Canada, Jun. 10-12, 2003").

Heins, W., McNeill, R., Albion, S., World's First SAGD Facility Using Evaporators, Drum Boilers, and Zero Discharge Crystallizers to Treat Produced Water, Canadian International Petroleum Conference, Paper No. 2005-115, Petroleum Society, Jun. 2005.

Heins, W.F., Start-Up, Commissioning, and Operational Data From the World's First SAGD Facilities Using Evaporators to Treat Produced Water for Boiler Feedwater, Canandian International Petroleum Conference, Paper No. 2006-183, Petroleum Society, Jun. 2006.

Heins, W.F., Is A Paradigm Shift in Produced Water Treatment Technology Occurring At SAGD Facilities?, Canadian International Petroleum Conference, Paper No. 2007-213, Petroleum Society, Jun. 2007.

Kok,S., Zaidi, A., and Solomon, R., Total dissolved Solids Removal From Water Produced During The In Situ Recovery of Heavy Oil and Bitumen, Preprint, Petroleum Society of CIM, Paper No. 86-37-64, Jun. 1986, (pp. 367-373).

Kok,S., Zaidi, A., and Solomon, R., Total dissolved Solids Removal From Water Produced During The In Situ Recovery of Heavy Oil and Bitumen, Advances in Thermal Recovery, The Journal of Canadian Petroleum Technology, vol. 26, No. 1, pp. 100-105, Jan. 1989.

Smith, Maurice, Watershed Moment, SAGD Operators Embrace New Water Treatment Options, Nickle's New Technology Magazine, Oct. 2007.

Smith, Maurice, Bridge Over Troubled Water, Simplifying Water Purification for Increasingly Thirsty Oilsands Extractors, (Web Page); www.ntm.nickles.com/New Technology Magazine, Jul./Aug. 2001 (pp. 37-39).

Solomon, R.L, and Schooley, K.E., Recycling Oil-field Produced Waters Using Evaporation Technology, American Filtration Society, National Fall Meeting, Oct. 29-30, 1990, Baton Rouge, Louisana. (11 pages including tables and Figures).

Zaidi, Abbas and Kok, Sandra, Recent Advances in the Treatment of Water from In-Situ Heavy Oil Recovery, Environment Canada, Wastewater Technology Center, Second Canada-China Heavy Oil Technology Symposium Proceedings, Oct. 1990, (Presentation).

Zaidi, Abbas and Kok, Sandra, Recent Advances in the Treatment of Water from In-Situ Heavy Oil Recovery, Environment Canada, Wastewater Technology Center, Second Canada-China Heavy Oil Technology Symposium Proceedings—Reprint, (1990).

Zalewski, W.; Averill, R.; Arychuk, G., Produced Water Recycyling At BF Resources—Petro Canada's Wolf Lake Plant, Mar. 14, 1991.

Koren, A., and Nadav, N. Mechanical Vapour Compression to Treat Oil Field Produced Water, I.D.E. Technologies Ltd., Desalination 98 (1994) 41-48, Elsevier Science B.V., Amsterdam.

Public Works Bulletin 420-49-05, Industrial Water Treatment Procedures, Feb. 2, 1998, U.S. Army Center for Public Works, (153 pages).

* cited by examiner

VERTICAL TUBE FALLING FILM VAPOR COMPRESSION EVAPORATOR SCHEMATIC

SILICA SOLUBILITY CHARACTERISTICS

SEEDED-SLURRY SCALE PREVENTION MECHANISM

TREATMENT OF BRINES FOR DEEP WELL INJECTION

RELATED PATENT APPLICATIONS

This application is a Continuation-In-Part of prior U.S. patent application Ser. No. 11/149,072, filed on Jun. 8, 2005 now U.S. Pat. No. 7,438,129. That application claimed priority from U.S. Provisional Patent Application Ser. No. 60/578,810, filed Jun. 9, 2004, and prior U.S. patent application Ser. No. 10/868,745, filed Jun. 9, 2004, which was a Continuation-In-Part of prior U.S. patent application Ser. No. 10/307,250, filed Nov. 30, 2002, now U.S. Pat. No. 7,077,201 B2, issued Jul. 18, 2006, entitled WATER TREATMENT METHOD FOR HEAVY OIL PRODUCTION, which was a Continuation-In-Part of prior U.S. patent application Ser. No. 09/566,622, filed May 8, 2000, now U.S. Pat. No. 6,733,636B1 issued May 11, 2004, entitled WATER TREATMENT METHOD FOR HEAVY OIL PRODUCTION, which claimed priority from prior U.S. Provisional Patent Application Ser. No. 60/133,172, filed on May 7, 1999. The disclosures of each of the above identified patents or patent applications are incorporated herein in their entirety by this reference, including the specification, drawing, and claims of each patent or application.

COPYRIGHT RIGHTS IN THE DRAWING

A portion of the disclosure of this patent document contains material that is subject to copyright protection. The applicant no objection to the facsimile reproduction by anyone of the patent document or the patent disclosure, as it appears in the Patent and Trademark Office patent file or records, but otherwise reserves all copyright rights whatsoever.

TECHNICAL FIELD

This invention is related to the treatment of wastewater brines prior to disposal by underground injection, particularly where the wastewater brines result from the treatment of water for steam generation in operations which utilize steam to recover oil from geological formations.

BACKGROUND

Steam generation is necessary or desirable in many heavy oil recovery operations, including, for example, the recovery of tar sands from deposits in Northern Alberta, Canada, or elsewhere around the world. This is because in order to recover heavy oil from certain geologic formations, heating is required to increase the mobility of the oil to be recovered from the geologic formation. In order to produce steam for downhole use, water treatment plants are necessary to produce high quality water meeting the applicable specifications for a selected high pressure steam generator system. In most cases, the primary source of water to be treated in order to manufacture the required steam in the selected high pressure steam generator is de-oiled produced water, i.e. the water which is brought up along with the oil by production wells when oil is removed from the geologic formation. In such instances, oil must be separated from the produced water in order to provide a de-oiled produced water suitable for further treatment, prior to steam generation.

Various processes have been heretofore utilized or proposed for treatment of de-oiled produced waters. In those situations where the de-oiled produced waters contain relatively high levels of silica, the wastewater brines produced by the required water treatment plant inevitably contain high levels of silica. Silica is relatively soluble at high pH, however, high pH waters may, in some locales, be unsuitable for disposal by underground injection. The manufacture of wastewater brines for underground injection at neutral or near neutral pH would be desirable in order to eliminate the necessity to neutralize high pH wastewater brines, as well as the necessity to reduce or effectively eliminate from such wastewater brines the presence of silica above solubility limits before underground injection.

Thus, it can be appreciated that it would be advantageous to provide a produced water treatment process which minimizes the production of high pH wastewater brine streams, and that produces a neutral or near neutral pH wastewater brine suitable for underground injection.

BRIEF DESCRIPTION OF THE DRAWING

In order to enable the reader to attain a more complete appreciation of the novel water treatment process disclosed and claimed herein, and the various embodiments thereof, and of the novel features and the advantages thereof over prior art processes, attention is directed to the following detailed description when considered in connection with the accompanying figures of the drawing, wherein:

The foregoing figures, being merely exemplary, contain various elements that may be present or omitted from actual process implementations depending upon the circumstances. An attempt has been made to draw the figures in a way that illustrates at least those elements that are significant for an understanding of the various embodiments and aspects of the invention. However, various other elements of the unique process methods, and the combination of apparatus for carrying out the methods, are also shown and briefly described to enable the reader to understand how various features, including optional or alternate features or procedures, may be utilized in order to provide an efficient, cost effective process design which can be implemented in a desired throughput size and physical configuration for providing an optimum produced water treatment plant utilizing a calcium sulfate seeded crystallizing evaporator having an evaporator blowdown treatment system that produces a clear, effectively solids free treated brine suitable for downhole injection into a selected geologic formation.

DESCRIPTION

Figure 1:
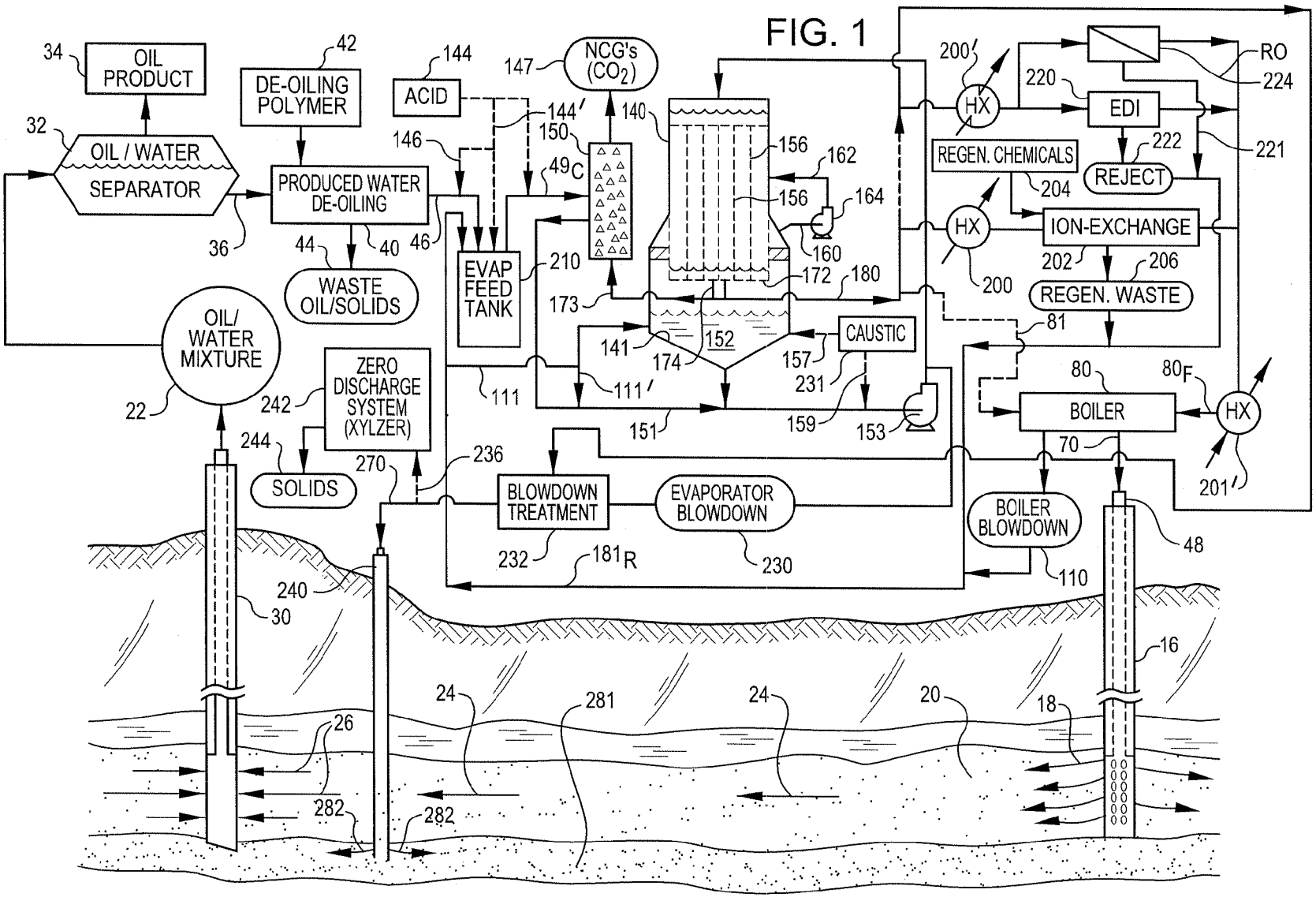
FIG. 1 illustrates one embodiment of an evaporation based water treatment process, illustrating the use of a seeded slurry crystallizing evaporator based process in combination with the use of packaged boilers for steam production, as applied to heavy oil recovery operations, and where one or more blowdown treatment processes as disclosed and claimed herein are utilized prior to injection of waste brine into a geological formation.
Figure 2:
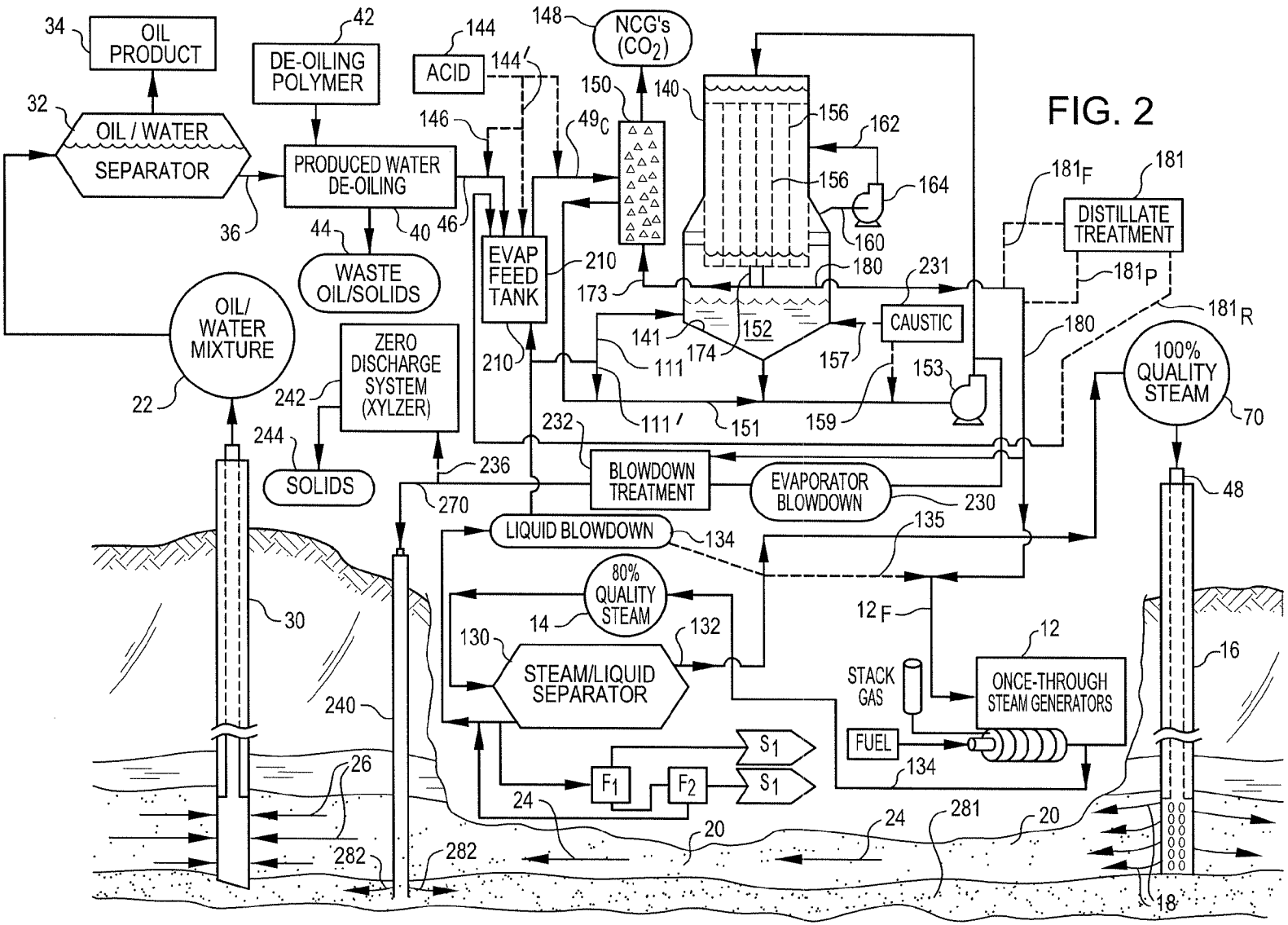
FIG. 2 illustrates another embodiment for an evaporation based water treatment process for heavy oil production, illustrating the use of a seeded slurry evaporation process in combination with the use of once-through steam generators for steam production, as applied to heavy oil recovery operations, wherein evaporator distillate is fed to once-through steam generators, and where one or more blowdown treatment processes as disclosed and claimed herein are utilized prior to injection of waste brine into a geological formation.

Many steam assisted heavy oil recovery schemes, such as a steam assisted gravity drainage ("SAGD") heavy oil recovery process injection and recovery well arrangements, most efficiently utilize a 100% quality steam supply. Steam is injected downhole in a first geological formation and is used to heat, in situ, heavy oil deposits in the first geologic formation to decrease the viscosity of the oil so as to mobilize the heavy oil so that it will flow toward oil/water collection wells. Several workable embodiments for suitable for heavy oil recovery, utilizing produced water as a water makeup source to the water treatment system for treatment of feedwater to boilers to make steam, are depicted in FIGS. 1 and 2. Additional details for a calcium sulfate seeded slurry crystallizing evaporator are provided in FIGS. 4 and 6.

As depicted in FIGS. 1 and 2, high pressure steam 70 is supplied to wellhead 48 and thence into injection well 16 for travel downhole into a selected first geological formation 20, and steam 70 emerges outward in the direction of reference arrows 18. After traveling through the first geological formation 20 as indicated by reference arrows 24, to heat and mobilize heavy oils present therein, at a selected spaced apart distance, oil/water gathering wells 30 are advantageously utilized for collecting an oil/water mixture as represented by reference arrows 26 into the oil/water gathering wells 30. The oil/water gathering wells 30 collect the oil produced from the first geological formation 20, as well as the condensate from steam injected into the first geological formation 20, and infiltration water to the first geological formation 20. The injection wells 16 and the oil/water gathering wells 30 may have one or more lateral or substantially horizontal legs, as suitable for oil production in a given formation, and, in a typical SAGD production environment, such lateral or substantially horizontal legs of injection wells 16 may lie above those of the lateral or substantially horizontal legs of oil/water gathering wells 30, so that a gravity drainage system is provided for collection of an oil/water mixture 22.

As shown in FIGS. 1 and 2, an oil/water mixture 22 is pumped up through oil gathering wells 30. The oil/water mixture 22 is sent to one or more oil/water separators 32. An oil product 34 is gathered for further conditioning, transport, and sale. The produced water 36 which has been separated from the oil/water mixture 22 is then sent to a produced water de-oiling process unit 40, which may be accomplished in dissolved air flotation units with the assistance of the addition of a de-oiling polymer 42, or by other appropriate unit processes, to achieve a preselected low residual oil level such as less than 20 parts per million of oil in the de-oiled produced water stream 46. Waste oil/solids 44 are rejected from the produced water de-oiling process unit 40. The de-oiled produced water 46 generated can be advantageously treated by a crystallizing evaporative process operating in a seeded slurry mode, particularly if the oil in the de-oiled produced water is reduced reliably to a selected low level of less than about 20 parts per million of oil, or more preferably to less than about 10 parts per million of oil. Such a treatment method provides a reliable, simple, straightforward process for produced water treatment, to produce high quality steam 70 for use in the recovery of a heavy oil product 34.

In an embodiment of the water treatment method disclosed herein, the de-oiled produced water stream 46 is treated and conditioned for feed to one or more mechanical vapor recompression evaporator units 140 (in most oil fields, multiple redundant units may be utilized) to concentrate the incoming de-oiled produced water stream 46. One suitable evaporator unit 140 configuration is a long tube vertical falling film design, wherein the feedwater from which a portion of water is to be evaporated is circulated on the tube side, and steam for heating is provided on the shell side of a vertical tube bundle, which design will be known to those of ordinary skill in the art and to whom this specification is addressed. A simplified long tube vertical falling film evaporator unit 140 system design for use in the treatment of de-oiled produced water stream 46 is provided in FIG. 4.

The necessary pretreatment and conditioning of the de-oiled produced water 46 prior to the evaporator unit 140 may vary somewhat based on feedwater chemistry—i.e. the identity and distribution of various dissolved and suspended solids within the de-oiled produced water 46, as well as on the degree of concentration selected for accomplishment within the evaporator units 140. In some embodiments, as shown in FIGS. 1 and 2, it may be necessary or appropriate to add acid 144 by line 144', or at an appropriate point upstream of the feed tank 210, such as via line 146. A selected suitable acid (which includes sulfuric acid or hydrochloric acid), which should be effective to lower the pH sufficiently so that carbonates and bicarbonates in solution are converted to free gaseous carbon dioxide which is removed, if not before, then at least by time of passage through feedwater deaerator 150. Deaerator 150 also removes, in addition to carbon dioxide, other non-condensable gases 147 that are dissolved in the feedwater 46, such as oxygen and nitrogen. However, use of acid 144 in this manner may be optional, and can sometimes be avoided if feedwater chemistry and the concentration limits of adverse scale forming species, and in particular alkali metal carbonates and bicarbonates, are sufficiently low at the anticipated concentration factor utilized in crystallizing evaporator 140. For pH control, it may sometimes be useful to raise the pH of operation of the crystallizing evaporator 140 by addition of a selected base such as caustic (sodium hydroxide) 231 to the concentrated brine recirculating in the evaporator 140, which can be accomplished by direct injection of a selected base such as caustic 231 into the sump 141, as indicated by line 157, or by feed of a selected base such as caustic 231 into the suction of recirculation pump 153, as indicated by line 159.

When the produced water contains an appreciable amount of silica, and/or an appreciable amount of calcium and sulfate, the mechanical vapor recompression evaporator 140 may in one embodiment be operated using a calcium sulfate seeded-slurry technique. A suitable configuration for such an evaporator is set forth in FIGS. 4 and 6. In one embodiment, the seeded slurry technique may be operated in a near neutral pH range, i.e., from a pH of about 5.5 to a pH of about 8.0, or more preferably, from a pH of about 6.5 to a pH of about 7.5 or so. A calcium sulfate seeded slurry mode of operation is made possible by the substantial elimination of non-hydroxide alkalinity before the feedwater is introduced into the crystallizing evaporator 140. That way, carbonate scale is not encountered when the de-oiled produced water 46 that has been pre-treated is provided as acidified evaporator feedwater $\mathbf{49}_C$ that has been steam stripped in deaerator 150 is concentrated in the crystallizing evaporator 140. The evaporator 140 is operated a seeded-slurry mode wherein calcium sulfate and silica are preferentially co-precipitated on recirculating seed crystals, which avoids scaling of the heat transfer surfaces of the evaporator.

Figure 4:
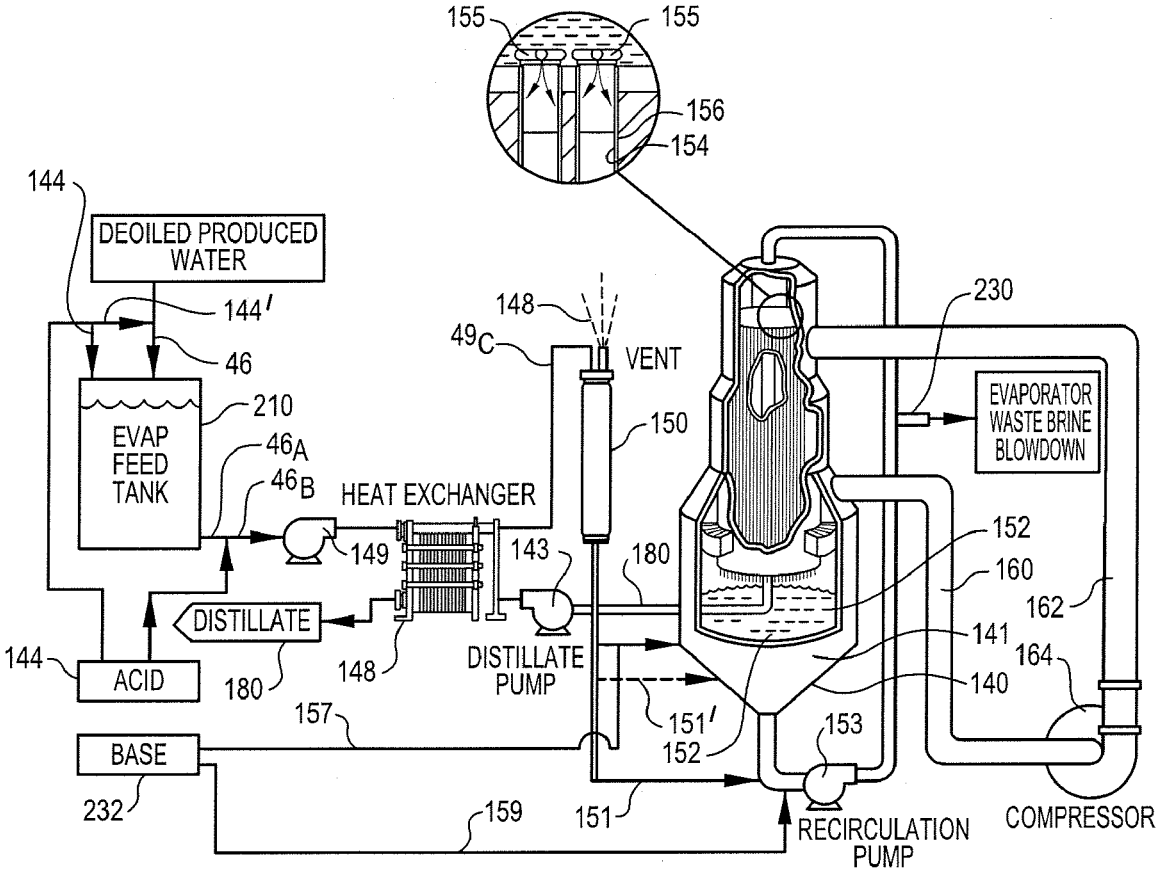
FIG. 4 shows further details of an evaporator system set up to process de-oiled produced water and to produce an evaporator waste brine blowdown.
Figure 5:
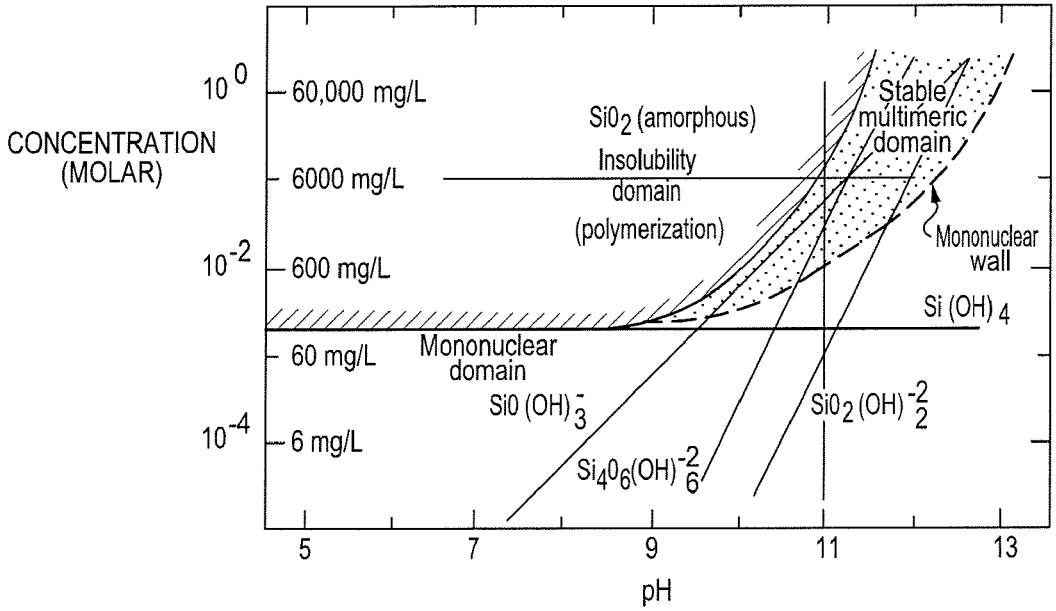
FIG. 5 provides solubility characteristics of silica in water, as a function of pH at 25° C. when silica species are in equilibrium with amorphous silica, as well as the nature of such soluble silica species (molecule or ion) at various concentration and pH ranges, and is provided to remind those of skill in the art of the need to control silica content in waste brines that are discharged at neutral or near neutral pH, since at such conditions silica solubility is quite limited in aqueous solution.

As further shown in FIG. 4, at feedwater heat exchanger, the feedwater pump 149 is used to provide sufficient pressure to send partially pre-treated feedwater $\mathbf{46}_A$ from the evaporator feed tank 210 (or feedwater 46B, if further pre-treatment using direct acid injection is utilized) through the feedwater heat exchanger 148, prior to the deaerator 150. In the opposite direction, the distillate pump 143 moves distillate 180 through the feedwater heat exchanger 148, so that the hot distillate is used to heat the feedwater stream directed toward the deaerator 150.

Figure 3:
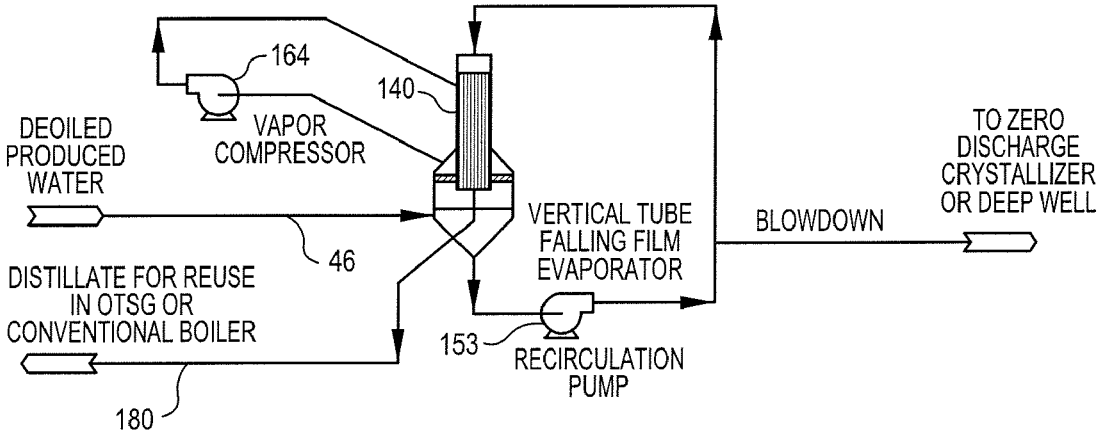
FIG. 3 provides a conceptual process flow diagram for the use of an evaporator to process de-oiled produced water, to produce a pure distillate for reuse, and to produce a brine that can be further treated for zero discharge by use of a crystallizer or for deep well injection by a brine treatment process as disclosed herein.

The heated and conditioned evaporator feedwater 151 is sent to the crystallizing evaporator 140. The conditioned feedwater 151 may be directed to the inlet of recirculation pump 153, or alternately, directed to the sump 141 of evaporator 140 as indicated by broken line 151' in FIG. 4. Concentrated brine 152 in the evaporator 140 is recirculated via pump 153, so only a small portion of the recirculating concentrated brine is removed on any one pass through the evaporator 140. In the evaporator 140, the solutes are concentrated via removal of water as condensed distillate 180. As depicted in FIGS. 1, 2, 3, 4 and 6, an evaporator 140 is in one embodiment provided in a falling film configuration wherein a thin brine film 154 is provided by distributors 155 and then falls inside one of the plurality of heat transfer elements 156, which in the embodiment illustrated in FIGS. 3 and 4, are long tubes. A small portion of the water in the thin brine film 154 is extracted in the form of steam 160, after heating of the brine film 154 though one of the plurality of heat transfer elements 156 from the heated, compressed steam 162 which is condensing on the outside of the plurality heat transfer elements 156. Thus, water is removed from the thin brine film 154 in the form of steam 160, and that steam is compressed through the compressor 164, and the compressed steam 162 is condensed at one or more of the plurality of heat transfer elements 156. The heat provided by the condensing of compressed steam 162 produces yet more steam 160 to continue the evaporation process. The condensed steam on the outer wall 168 of one of the plurality of heat transfer elements 156, e.g. tubes as illustrated in FIG. 4, which those of ordinary skill in the evaporation arts and to which this disclosure is directed may variously refer to as either condensate or distillate 180, is water in relatively pure form, that is to say, low in total dissolved solids. In one embodiment, such distillate contains less than 10 parts per million of total dissolved solids of non-volatile components. Since, as depicted in the embodiments shown in FIGS. 3 and 4, a single stage of evaporation is provided, such distillate 180 may be considered to have been boiled, or distilled, once, and thus condensed but once.

Prior to the initial startup of the crystallizing evaporator 140 in the seeded-slurry mode, the crystallizing evaporator 140, which in such mode may be provided in a falling-film, mechanical vapor recompression configuration, the fluid contents of the unit are "seeded" preferably by the addition of anhydrous calcium sulfate crystals 272. The seed crystals 272 circulate as solids within the brine slurry and serve as nucleation sites for subsequent precipitation of calcium sulfate 272, as well as silica 274. Those substances both are precipitated as an entering evaporator feedwater 46 is concentrated to an evaporator waste blowdown 230 of desired final total dissolved solids concentration, which may be up to as much as twenty five percent (25%) or more. Importantly, the continued concentrating process within crystallizing evaporator 140 produces additional quantities of the precipitated species, and thus creates a continuing source of new "seed" material as these particles are broken up by the mechanical agitation, particularly by the action of the recirculation pump 153.

Figure 6:
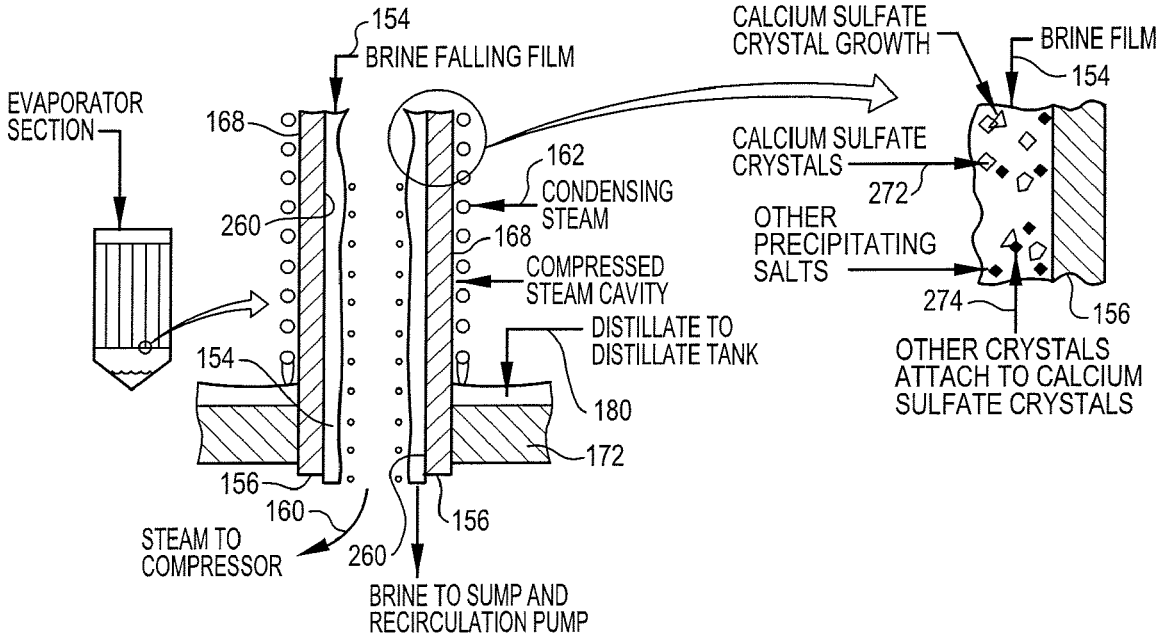
FIG. 6 illustrates certain details of a crystallizing evaporation system that utilizes co-precipitation of calcium sulfate and silica to minimize and/or prevent silica scaling in the crystallizing evaporator.

In order to avoid silica and calcium sulfate scale buildup in the evaporator 140, calcium sulfate seed crystals 272 are continuously circulated over the wetted surfaces, i.e., the plurality of heat transfer elements such as falling film evaporator tubes, as well as other wetted surfaces in the evaporator 140. Through control of slurry concentration, seed characteristics, and system geometry, the evaporator can operate in the otherwise scale forming environment. The thermo chemical operation within the evaporator 140 with regard to the scale prevention mechanism is depicted in FIG. 6. As the water is evaporated from the brine film 154 inside the heat transfer elements 156 (such long tubes), the remaining brine film becomes super saturated and calcium sulfate and silica start to precipitate. The precipitating material promotes crystal growth in the slurry rather than new nucleation that would deposit on the heat transfer surfaces; the silica crystals attach themselves to the calcium sulfate crystals. This scale prevention mechanism, called preferential precipitation, has a proven capability to promote clean inner heat transfer surfaces 260 of tubes 156. The details of one advantageous method for maintaining adequate seed crystals in preferential precipitation systems are set forth in U.S. Pat. No. 4,618,429, issued Oct. 21, 1986 to Howard R. Herrigel, the disclosure of which is incorporated into this application in full by this reference.

It is to be understood that a falling film evaporator 140 design is provided only for purposes of illustration and thus enabling the reader to understand the water treatment process (es) taught herein, and is not intended to limit the process to the use of such evaporator design, as those of ordinary skill in the art will recognize that other crystallizing evaporator designs, such as, for example, a forced circulation evaporator, may be alternately utilized with the accompanying benefits and/or drawbacks as inherent in such alternative evaporator designs.

By way of example, and not for purposes of limitation, in a falling film evaporator embodiment, the distillate 180 descends by gravity along the outer wall 168 of tubes 156 and accumulates above bottom tube sheet 172, from where it is collected via condensate line 174. A small portion of steam in equilibrium with distillate 180 may be sent via line 173 to the earlier discussed deaerator 150 for use in mass transfer, i.e, heating and steam stripping descending liquids in a packed tower to remove non-condensable gases 147 such as carbon dioxide. However, the bulk of the distillate 180 is removed as a liquid and may optionally be sent for further treatment in a distillate treatment plant, for example such as depicted in detail in FIG. 1, or as merely depicted in functional form as feed $\mathbf{181}_F$ for plant 181 in FIG. 2, to ultimately produce a treated distillate product water $\mathbf{181}_P$ which is suitable for boiler feedwater, such as feedwater $\mathbf{80}_F$ in the case where packaged boilers 80 are utilized as depicted in FIG. 1. The distillate treatment plant 181 also normally produces a reject stream $\mathbf{181}_R$ which may be recycled to the evaporator feed tank 210 or other suitable location for reprocessing or reuse. In one embodiment, the reject stream $\mathbf{181}_R$ may be sent directly back to the liquid sump 141 of crystallizing evaporator 140 via line 111. In another embodiment, the reject stream $\mathbf{181}_R$ may be sent back for injection via line 111' to the inlet to the recirculation pump 153. As shown in the embodiment set forth in FIG. 2, the distillate treatment plant 181 may be optional, especially in the case of the use of once through steam generators 12 as depicted in FIG. 2, and in such instance the distillate 180 may often be sent directly to once-through steam generators 12 as feedwater stream $\mathbf{12}_F$. Also, as shown in FIG. 1 a distillate treatment plant 181 may also be optional in some cases, depending on feedwater chemistry, and in such cases, distillate 180 may be fed directly to boiler 80 as indicated by broken line 81.

In an embodiment where steam generators (e.g., boilers 80) are used as shown in FIG. 1, high pressure steam 70 will be generated, and a boiler blowdown stream 110 will be discharged as necessary to control water chemistry within the boiler 80. Prior to feed of distillate 180 to boiler 80, it may be necessary or desirable to remove the residual organics and other residual dissolved solids from the distillate 180. For example, as illustrated in FIG. 1, in some cases, it may be necessary to remove residual dissolved solids from the relatively pure distillate 180 produced by the evaporator 140.

In one embodiment, removal of residual dissolved solids can be accomplished by passing the evaporator distillate 180, after heat exchanger 200, through an ion exchange system 202. Such ion-exchange systems may be of mixed bed type or include an organic trap, and effective to remove the salts and/or organics of concern in a particular distillate 180 being treated. In any event, regenerant chemicals 204 will ultimately be required, which regeneration results in a regeneration waste 206 that must be further treated. Fortunately, in the process scheme described herein, the regeneration waste 206 can be sent back to the evaporator feed tank 210 (along with other distillate treatment plant 181 reject waters $\mathbf{181}_R$) for a further cycle of treatment through the evaporator 140.

In another embodiment, removal of residual dissolved solids can be accomplished by passing the evaporator distillate 180 through a heat exchanger 200' and then through electrodeionization (EDI) system 220. The EDI reject 222 is also capable of being recycled to evaporator feed tank 210 (along with other distillate treatment plant 181 reject waters $\mathbf{181}_R$) for a further cycle of treatment through the evaporator 140.

In another embodiment, when a reverse osmosis system 224 is utilized, the reject stream includes the RO reject stream 221 which is recycled to be mixed with the de-oiled produced water stream 46 in the evaporator feed tank 210 system, for reprocessing through the evaporator 140. Likewise, when ion-exchange system 202 is utilized, the regenerant waste stream 206 is recycled to be mixed with the de-oiled produced water 46 in the evaporator feed tank system, for reprocessing through the evaporator 140. After processing in distillate treatment plant 181, heating of the polished distillate by heat exchanger 201' is appropriate to produce a heated feedwater $\mathbf{80}_F$ for boiler 80.

In the process disclosed herein, the evaporator 140 is designed to produce high quality distillate (typically about 2 ppm to about 5 ppm non-volatile TDS) which, after temperature adjustment to acceptable levels in heat exchangers 200 or 200' (typically by cooling to about 45° C., or lower) can be fed directly into polishing equipment (EDI system 220, or ion exchange system 202, or reverse osmosis system 224) for removal of dissolved solids. The water product produced by the distillate treatment plant 181 equipment just mentioned is most advantageously used as feedwater for the packaged boiler 80. That is because in the typical once-though steam generator 12 used in oil field operations, it is normally unnecessary to incur the additional expense of final polishing by removal of residual total dissolved solids from the evaporator distillate stream 180. However, in some applications, final polishing may not be necessary when using conventional boilers 80. It may be appropriate in some embodiments from a heat balance standpoint that the de-oiled produced waters 46 fed to the evaporator for treatment be heated by heat exchange with the distillate stream 180. However, if the distillate stream is sent directly to once-through steam generators 12, then no cooling of the distillate stream 180 may be appropriate. Also, in the case of once-through steam generators 12, in many embodiments, it may be necessary or appropriate run to utilize 80% quality steam 14 through a steam/liquid separator 130 to separate high quality steam 132 from liquid blowdown 134. Further the liquid blowdown 134 may be further processed for heat recovery in a plurality of flash tanks $F_1$, $F_2$ etc., to produce lower pressure steam streams $S_1$ and $S_2$, etc., for use as suitable given the pressure provided by the flash system, generally as shown in FIG. 2.

One of the significant economic advantages of using a vertical tube, falling film evaporator 140 such as of the type described herein is that the on-line reliability and redundancy available when multiple evaporators are utilized in the treatment of produced water. An evaporative based produced water treatment system can result in an increase of from about 2% to about 3% or more in overall heavy oil recovery plant availability, as compared to a produced water treatment system utilizing a conventional prior art lime and clarifier treatment process approach. Such an increase in on-line availability relates directly to increased oil production and thus provides a large economic advantage over the project life of a heavy oil recovery plant.

The just described novel combination of process treatment steps produces feedwater of sufficient quality, and in economic quantity, for use in packaged boilers 80 in heavy oil recovery operations. Advantageously, when provided as depicted in FIG. 1 a single liquid waste stream is generated, namely evaporator blowdown 230, which contains the concentrated solutes originally present in de-oiled produced water 46, along with additional contaminants from chemical additives (such as regeneration chemicals 204). In many cases, the evaporator blowdown 230 can be further treated for disposal in an environmentally acceptable manner, which, depending upon locale, might involve injection in deep wells 240. Alternately, evaporation to complete dryness in a zero discharge system 242, such as a crystallizer or drum dryer, to produce dry solids 244 for disposal, may be advantageous in certain locales.

It is to be appreciated that the water treatment process described herein for preparing boiler feedwater in heavy oil recovery operations is an appreciable improvement in the state of the art of water treatment for oil recovery operations. The process eliminates numerous of the heretofore encountered waste streams, while processing water in reliable mechanical evaporators, and in one embodiment, in mechanical vapor recompression ("MVR") evaporators. Polishing, if necessary, can be accomplished in ion exchange, electrodeionization, or reverse osmosis equipment. The process thus improves on currently used treatment methods by eliminating most treatment or regeneration chemicals, elimination many waste streams, eliminating some types of equipment. Thus, the complexity associated with a high number of treatment steps involving different unit operations is avoided.

It should also be noted that the process described herein can be utilized with once through steam generators, since due to the relatively high quality feedwater—actually treated produced water—provided to such once through steam generators, the overall blowdown rate of as low as about 5% or less may be achievable in the once through steam generator. Alternately, as shown in FIG. 2, at least a portion of the liquid blowdown 134 from the once through steam generator 12 can be recycled to the steam generator 12, such as indicated by broken line 135 to feedwater stream $\mathbf{12}_F$.

In yet another embodiment, to further save capital and operating expense, industrial boilers of conventional design may be utilized since the distillate—treated produced water—may be of sufficiently good quality to be an acceptable feedwater to the boiler, even if it requires some polishing. It is important to observe that use of such boilers reduces the boiler feed system and evaporative produced water treatment system size by twenty percent (20%), eliminates vapor/liquid separation equipment as noted above, and reduces the boiler blowdown flow rate by about ninety percent (90%).

In short, evaporative treatment of produced waters using a falling film, vertical tube evaporator is technically and economically superior to prior art water treatment processes for heavy oil production. It is possible to recover ninety five percent (95%) or more, and even up to ninety eight percent (98%) or more, of the produced water as high quality distillate 180 for use as high quality boiler feedwater (resulting in only a 2% boiler blowdown stream which can be recycled to the feed for evaporator 140). Such a high quality distillate stream may be utilized in SAGD and non-SAGD heavy oil recovery operations. Such a high quality distillate stream may have less than 10 mg/L of non-volatile inorganic TDS and is useful for feed either to OTSGs or to conventional boilers.

The overall life cycle costs for the novel treatment process described herein are significantly less than for a traditional lime softening and ion exchange treatment system approach. And, an increase of about 2% to 3% in overall heavy oil recovery plant availability is achieved utilizing the treatment process described herein, which directly results in increased oil production from the facility. Since boiler blowdown is significantly reduced, by as much as 90% or more, the boiler feed system may be reduced in size by as much as fifteen percent (15%) or more. Finally, the reduced blowdown size results in a reduced crystallizer size when zero liquid discharge is achieved by treating blowdown streams to dryness.

In the improved water treatment method, the control over waste streams is focused on a the evaporator blowdown, which can be conveniently treated by deep well 240 injection, or in a zero discharge system 242 such as a crystallizer and/or spray dryer, to reduce all remaining liquids to dryness and producing a dry solid 244. This contrasts sharply with the prior art processes, in which sludge from a lime softener is generated, and in which waste solids are gathered at a filter unit, and in which liquid wastes are generated at an ion exchange system and in the steam generators. Moreover, this waste water treatment process also reduces the chemical handling requirements associated with water treatment operations.

Evaporator blowdown 230 from the evaporator 140 is often suitable, or may be treated in a further evaporator blowdown treatment step 232 as indicated in FIGS. 1 and 2 and thus made suitable for disposal by injection into a geologic formation via deep well 240. Many produced waters encountered in heavy oil production are high in silica, with values that may range up to about 200 mg/l as $SiO_2$, or higher. Use of a seeded slurry operational configuration in evaporator 140 enables the co-precipitation of silica with precipitating calcium sulfate, to provide a process design which prevents the scaling of the inner heat transfer surfaces 260 of the plurality of heat transfer elements, namely tubes 156 with the ever-present silica. This is important, since silica solubility must be accounted for in the design and operation of the evaporator 140, in order to prevent silica scaling of the inner surfaces 260 of the plurality of heat transfer elements 156.

Attention is now directed to FIGS. 7, 8, 9, and 10, where process flow diagrams are provided for various exemplary embodiments $\mathbf{232}_A$, $\mathbf{232}_B$, $\mathbf{232}_C$, and $\mathbf{232}_D$ for a suitable evaporator blowdown treatment process 232. These process units, in most embodiments alternately one of $\mathbf{232}_A$, or $\mathbf{232}_B$, or $\mathbf{232}_C$, or $\mathbf{232}_D$, are provided prior to deep well 240 injection of clear treated brine 270. During such periods as deep well 240 may be out of service, either a clear treated brine 270 or untreated evaporator blowdown brine 230 may be provided to a zero discharge system 242 (normally a crystallizer) such as via optional line 236, for producing relatively dry solids 244 for land disposal or reuse.

Figure 7:
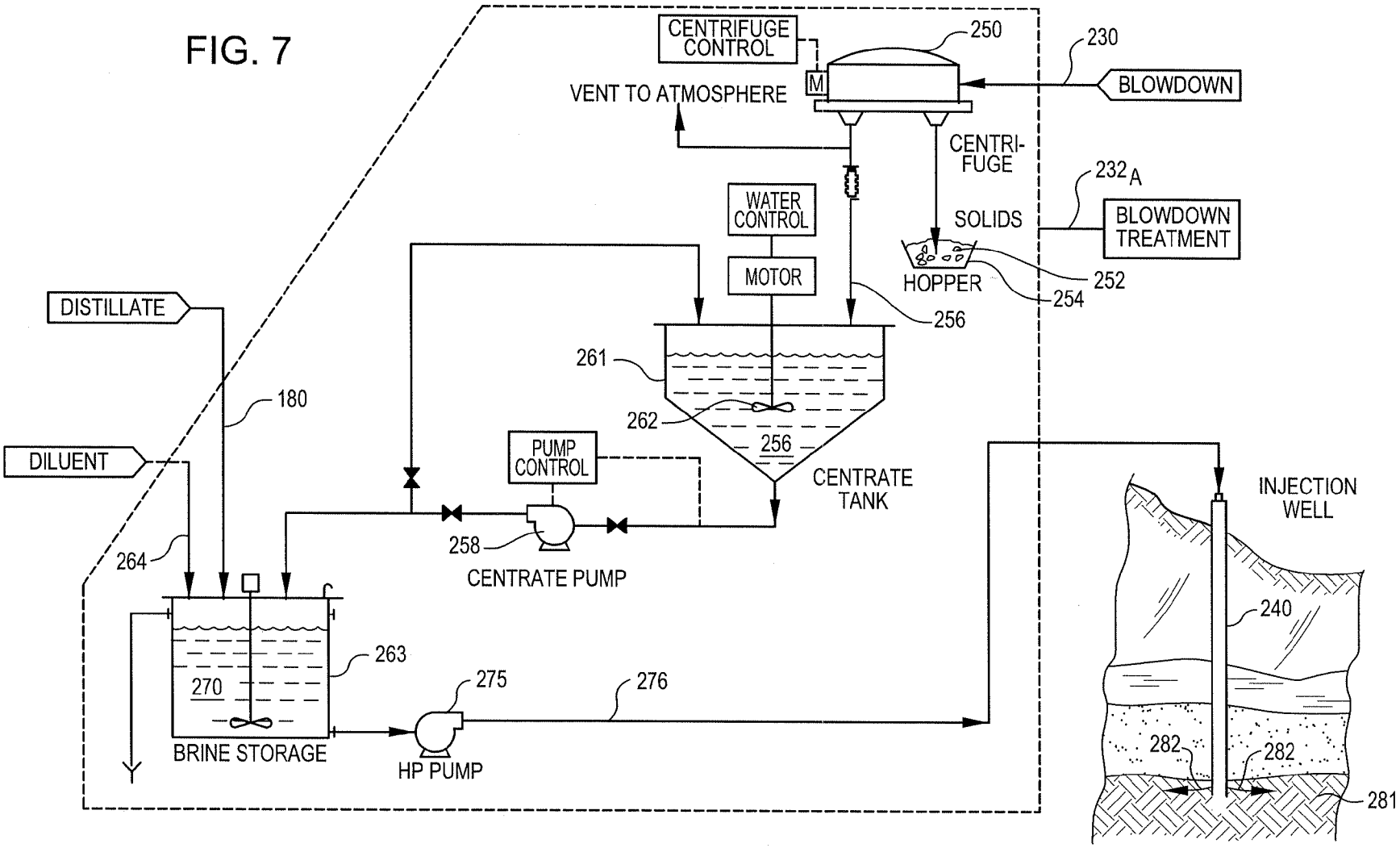
FIG. 7 illustrates one embodiment for a wastewater blowdown brine treatment system, wherein a wastewater blowdown brine comprises a seeded slurry, and wherein the solids in the seeded slurry wastewater blowdown brine are effectively removed by a centrifuge system, and wherein the resultant clear centrate is diluted with a suitable diluent such as evaporator distillate or other solvent such as service water (where suitable) to effectively eliminate the tendency of any remaining scaling constituents in the resultant clear brine to form scale when injected into a selected geological formation.

In FIG. 7, a centrifuge 250 based blowdown treatment system $\mathbf{232}_A$ is depicted. Evaporator blowdown 230, usually made up of a slurry of water containing dissolved solutes and suspended solids, requires removal of substantially all of the suspended solids therefrom, or at least those of any significant size compared to hydrogeologic passageways of a selected underground geologic formation 280. Thus, the waste seed from a calcium sulfate crystallizing evaporator 140 must be captured by a selected removal system, which as shown in FIG. 7 is centrifuge 250. The evaporator blowdown 230 is fed to centrifuge 250, where solids 252 are rejected to a hopper 254. The clear centrate 256 is sent to a centrate tank 261, where it may be stirred by mixer 262. Clear centrate 256 is sent via centrate pump 258 to a brine storage tank 263. Distillate 180 and/or other suitable diluent 264 such as a service water of suitable composition may be added to brine storage tank 263, and utilized to the extent necessary or advisable to prepare a clear brine solution 270 of a preselected composition. While further specifics will be discussed below, in one embodiment, the clear brine solution 270 may be of a preselected composition substantially free of suspended solids, and wherein the dissolved solids are provided at a level sufficiently below the solubility limit of scale forming species such that injection of clear brine solution 270 into well 240 will not tend to be adversely affected by precipitation of scale forming species in the down-hole geologic environment 280. A high pressure pump 275 is utilized to provide downhole pressure for injection into injection well 240, and transport of the clear brine 270 is provided by line 276 to well 240, where clear brine 270 is injected into the second geological formation 280 as indicated by reference arrows 282.

Figure 8:
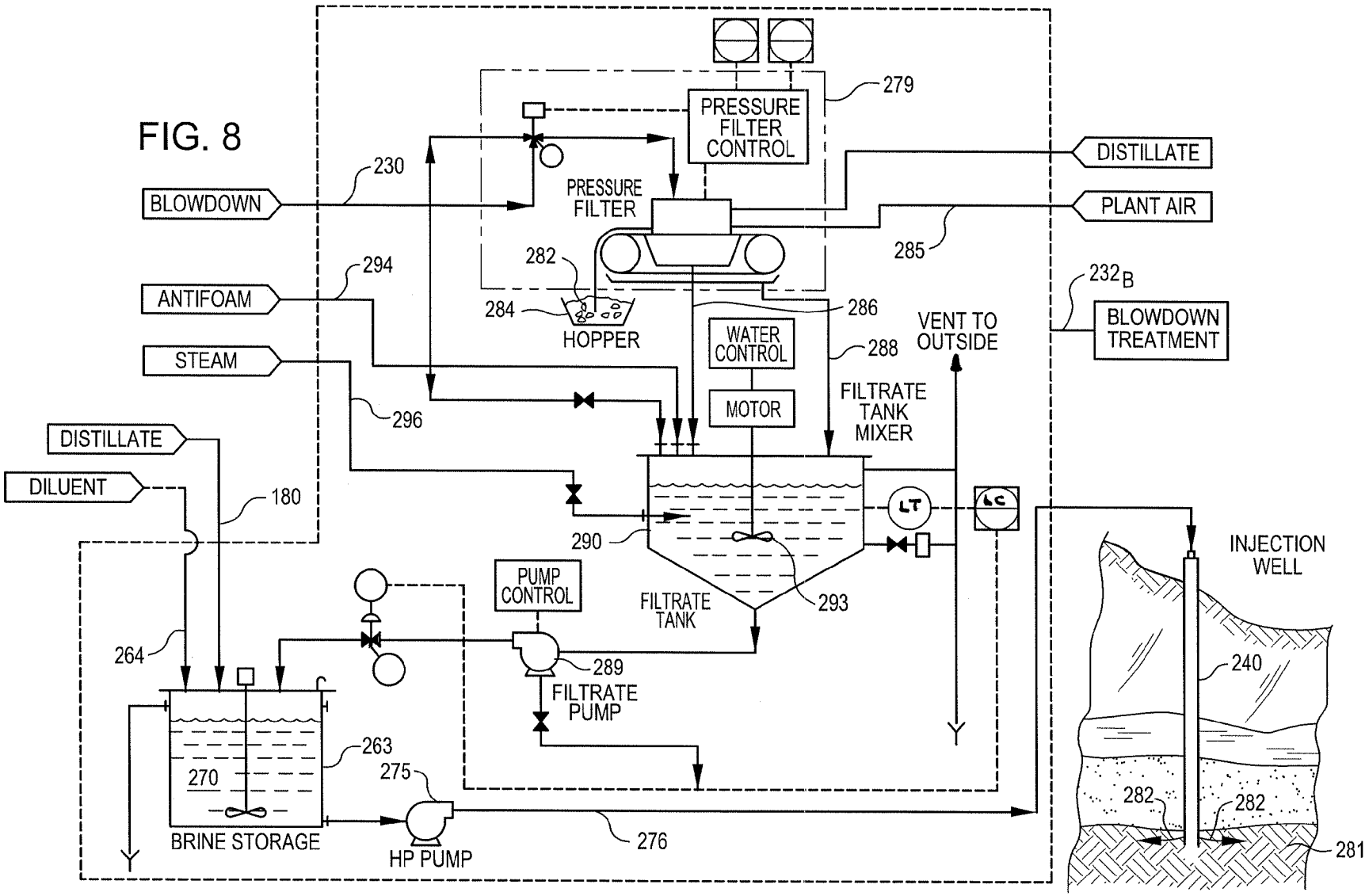
FIG. 8 illustrates one embodiment for a wastewater blowdown brine treatment system, wherein a wastewater blowdown brine comprises a seeded slurry, and wherein the solids in the seeded slurry wastewater blowdown brine are effectively removed by a filter press system, and wherein the resultant clear filtrate is diluted with a suitable diluent such as evaporator distillate or other solvent such as service water (where suitable) to effectively eliminate the tendency of any remaining scaling constituents in the resultant clear brine to form scale when injected into a selected geological formation.

In FIG. 8, a pressure filter 279 based blowdown treatment system $\mathbf{232}_B$ is depicted. Evaporator blowdown 230, usually made up of a slurry of water containing dissolved solutes and suspended solids, requires removal of substantially all of the suspended solids therefrom, or at least those of any significant size compared to hydrogeologic passageways of a selected second underground geologic formation 281. Thus, the waste seed from a calcium sulfate seeded crystallizing evaporator 140 must be captured by a selected removal system, which in this embodiment is pressure filter 279. The evaporator blowdown 230 is fed to pressure filter 279, where solids 282 are rejected to a hopper 284. Operation of the pressure filter may require distillate 180 and plant air 285. The clear filtrate 286 (and liquids from catch basin drain 288) are sent to a filtrate tank 290, where it may be stirred by mixer 293. In some cases, antifoam 294 and steam 296 may be added to filtrate tank 290, for foam suppression and heating, respectively. Clear filtrate 286 is sent via filtrate pump 289 to a brine storage tank 263. Distillate 180 and/or other suitable diluent 264 such as a service water of suitable composition may also be added to brine storage tank 263, and utilized to the extent necessary or advisable to prepare a clear brine solution 270 of a preselected composition. While further specifics will be discussed below, the clear brine solution 270 should be of a preselected composition substantially free of suspended solids, and wherein the dissolved solids are provided at a level sufficiently below the solubility limit of scale forming species such that injection of clear brine solution 270 into well 240 will not tend to be adversely affected by precipitation of scale forming species in the down-hole environment of second geological formation 281. A high pressure pump 275 is utilized to provide downhole pressure for injection into injection well 240, and the transport of clear brine 270 is provided by line 276 to well 240, where clear brine 270 is injected into the second geological formation 281 as indicated by reference arrows 282.

Figure 9:
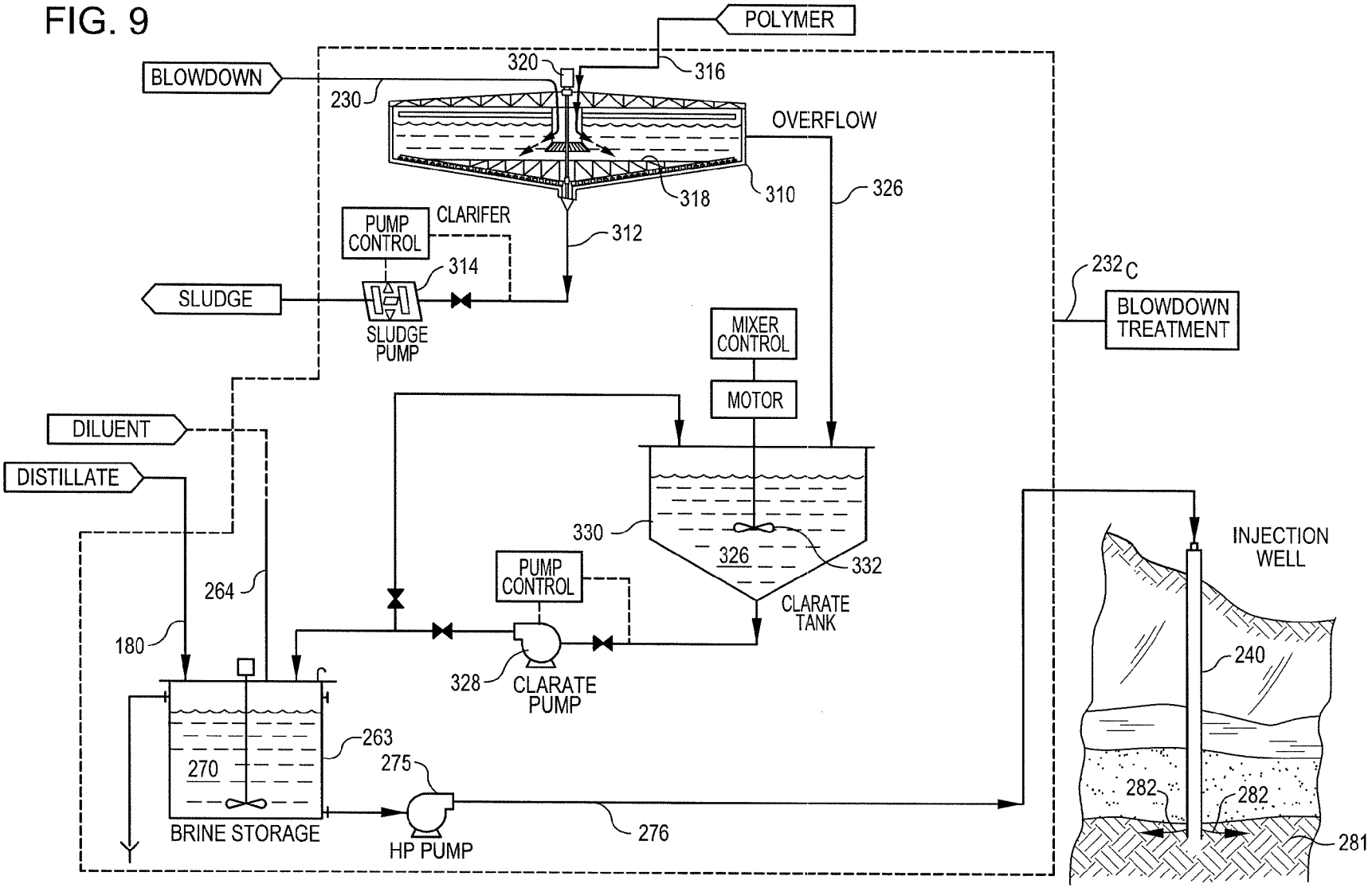
FIG. 9 illustrates one embodiment for a wastewater blowdown brine treatment system, wherein a wastewater blowdown brine comprises a seeded slurry, and wherein the solids in the seeded slurry wastewater blowdown brine are effectively removed by a clarifier system, and wherein the resultant clear clarifier overflow is diluted with a suitable diluent such as evaporator distillate or other solvent such as service water (where suitable) to effectively eliminate the tendency of any remaining scaling constituents in the resultant clear brine to form scale when injected into a selected geological formation.

Similarly, in FIG. 9, a clarifier 310 based blowdown treatment system $\mathbf{232}_C$ is depicted. Evaporator blowdown 230, usually made up of a slurry of water containing dissolved solutes and suspended solids, requires removal of substantially all of the suspended solids therefrom, or at least those of any significant size compared to hydrogeologic passageways of a selected second underground geologic formation 281. Thus, the waste seed from a calcium sulfate seeded crystallizing evaporator 140 must be captured by a selected removal system, which here, is clarifier 310. The evaporator blowdown 230 is fed to clarifier 310, where solids 312 are rejected as underflow to a sludge pump 314. Operation of the clarifier may require addition of flocculating polymers via line 316, and operation of a sludge rake 318 via motor 320. The clear overflow or clarate 326 is sent to a clarate tank 330, where it may be stirred by mixer 332. Clear overflow or clarate 326 is sent via clarate pump 328 to a brine storage tank 263. Distillate 180 and/or other suitable diluent 264 such as a service water of suitable composition may also be added to brine storage tank 263, and utilized to the extent necessary or advisable to prepare a clear brine solution 270 of a preselected composition. While further specifics will be discussed below, the clear brine solution 270 should be of a preselected composition substantially free of suspended solids, and wherein the dissolved solids are provided at a level sufficiently below the solubility limit of scale forming species such that injection of clear brine solution 270 into well 240 will not tend to be adversely affected by precipitation of scale forming species in the down-hole environment of second geological formation 281. A high pressure pump 275 is utilized to provide downhole pressure for injection into injection well 240, and the transport of clear brine 270 is provided by line 276 to well 240, where clear brine 270 is injected into the second geological formation 281 as indicated by reference arrows 282.

Figure 10:
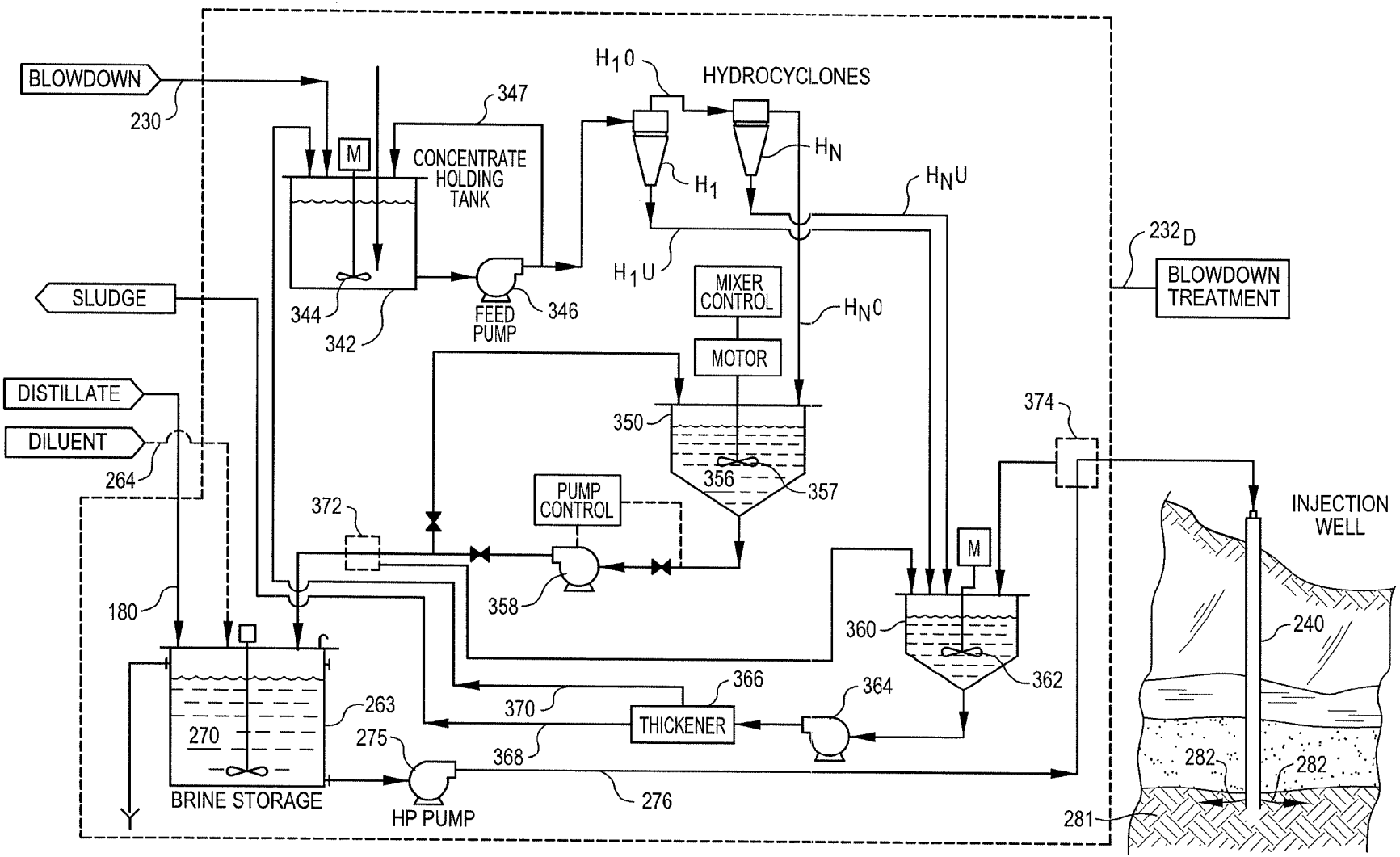
FIG. 10 illustrates one embodiment for a wastewater blowdown brine treatment system, wherein a wastewater blowdown brine comprises a seeded slurry, and wherein the solids in the seeded slurry wastewater blowdown brine are effectively removed by a hydrocyclone system, and wherein the resultant clear hydrocyclone overflow is diluted with a suitable diluent such as evaporator distillate or other solvent such as service water (where suitable) to effectively eliminate the tendency of any remaining scaling constituents in the resultant clear brine to form scale when injected into a selected geological formation.

In yet another embodiment, as shown in FIG. 10, a hydrocyclone based blowdown treatment system $\mathbf{232}_D$ is depicted. Evaporator blowdown 230, usually made up of a slurry of water containing dissolved solutes and suspended solids, requires removal of substantially all of the suspended solids therefrom, or at least those of any significant size compared to hydrogeologic passageways of a selected second underground geologic formation 281. Thus, the waste seed from a calcium sulfate seeded crystallizing evaporator 140 must be captured by a selected removal system, which here is a system of one or more hydrocyclones and where more than one, a series of hydrocyclones $H_1$ through $H_N$, where N is a positive integer. The evaporator blowdown 230 my be stored in a concentrate holding tank 342, where it is stirred by mixer 344 before feed via pump 346 to the first hydrocyclone $H_1$. A recycle loop 347 may be provided to avoid excess pressure on the hydrocyclones and to assist in keeping seed suspended in the circulating blowdown 230 at tank concentrate holding tank 342. Hydrocyclone overflow $H_1O$ from the first hydrocyclone $H_1$, low in suspended solids, is sent to the next hydrocyclone $H_{(1+1)}$, and likewise in series until the last hydrocyclone $H_N$ is encountered, wherein the overflow $H_NO$ is sent to the clear overflow tank 350. Clear overflow 356 is stored in clear overflow tank 350, and may optionally be stirred by mixer 357, before being sent by pump 358 to the brine storage tank 263. Solids from the first hydrocyclone $H_1$ and each subsequent hydrocyclone in the series through $H_N$ are sent via underflow lines $H_1U$ though $H_NU$ to the seed tank 360. Waste seed is stirred via mixer 362 and sent by pump 364 to thickener 366, which again may be a centrifuge, pressure filter, or clarifier system similar to that just described above. Sludge 368 is discharged and recovered brine 370 may be sent to centrate holding tank 342 for reprocessing in the manner described, or otherwise purged if advisable due to the presence of excess scale forming constituents. Distillate 180 and/or other suitable diluent 264 such as a service water of suitable composition may also be added to brine storage tank 263, and utilized to the extent necessary or advisable to prepare a clear brine solution 270 of a preselected composition. While further specifics will be discussed below, the clear brine solution 270 should be of a preselected composition substantially free of suspended solids, and wherein the dissolved solids are provided at a level sufficiently below the solubility limit of scale forming species such that injection of clear brine solution 270 into well 240 will not tend to be adversely affected by precipitation of scale forming species in the down-hole environment of second geological formation 281. A high pressure pump 275 is utilized to provide downhole pressure for injection into injection well 240, and the transport of clear brine 270 is provided by line 276 to well 240, where clear brine 270 is injected into the second geological formation 281 as indicated by reference arrows 282. To assure a solids free clear brine solution 270, an optional low pressure in-line filter 372 may be provided downstream of pump 358. Alternately, an optional high pressure in-line filter 374 may be provided downstream of high pressure pump 275 to provide final solids capture before injection to well 240.

With respect to the preparation of clear brine solution 270, it must be appreciated that the blowdown 230 will in most embodiments be saturated in one or more scale forming species. Typical scale forming species may include silica (both ionized and undissociated forms, depending upon the pH) calcium sulfate, barium compounds including barium sulfate, or strontium compounds including strontium sulfates. For example, silica, when in near neutral aqueous solution, may be present roughly in the range of about 200 parts per million, depending on the exact pH and other dissolved and suspended species present. Therefore, when the respective blowdown treatment plant prepares a substantially solids free brine liquor, whether centrate 256 in plant $\mathbf{232}_A$, or filtrate 292 in plant $\mathbf{232}_B$, or clarate 326 in plant $\mathbf{232}_C$, or overflow 356 in plant $\mathbf{232}_D$, it must be recognized that the precipitation sites for removal of silica from the solution have been eliminated by the seed removal, and thus, silica might tend to scale out of the silica saturated solution upon cooling or further concentration. Thus, such substantially suspended solids free brine liquor is generally not suitable for direct downhole injection. Therefore, it would often be advantageous to dilute such substantially suspended solids free brine liquor with a suitable diluent, such as the relatively pure distillate stream 180 (with about 10 ppm or less of non-volatile dissolved solids), or even post treated distillate $\mathbf{180}_P$ (with less than 1 ppm of non-volatile dissolved solids). If suitable service waters are available from other sources, that is, provided that the level of silica or other scale forming materials such as hardness and alkalinity are sufficiently low in such other potential diluents 264 that a clear brine solution 270 of suitable composition may be economically prepared and injected, then use of aqueous sources other than distillate stream 180 may be selected. However, in one embodiment, the distillate stream 180 is useful for addition to any one of the above mentioned substantially suspended solids free brine liquors (e.g., centrate 256, or filtrate 292, or clarate 326, or overflow 356), so that upon dilution (and thus before injection) the silica level in clear brine solution 270 is about 10%, or further, from the level of silica in the substantially suspended solids free brine liquor, which for most practical purposes, represents an equivalent dilution from the solubility limit of silica in clear brine solution 270. Similar dilution (i.e., 10%) for other of the one or more scale forming species may be appropriate, depending upon the precise chemistry in a particular application. Thus, when silica is present at about 200 parts per million (as $SiO_2$) in the selected substantially suspended solids free brine liquor, then dilution to a silica level of about 180 parts per million (as $SiO_2$) in the clear brine solution 270 is appropriate. In yet another embodiment, upon dilution, (and thus before injection) the silica level in clear brine solution 270 is about 20%, or further, from the level of silica in the substantially suspended solids free brine liquor, or consequently, from the solubility limit of silica in clear brine solution 270. Similar dilution (i.e., 20%) for other of the one or more scale forming species may be appropriate, depending upon the precise chemistry in a particular application. In such embodiment, when silica is present at about 200 parts per million (as $SiO_2$) in the selected substantially suspended solids free brine liquor, then dilution to a silica level of about 160 parts per million (as $SiO_2$) in the clear brine solution 270 is appropriate. In yet another embodiment, upon dilution, (and thus before injection) the silica level in clear brine solution 270 is about 25%, or further, from the level of silica in the substantially suspended solids free brine liquor, or consequently, from the solubility limit of silica in clear brine solution 270. Similar dilution (i.e., 25%) for other of the one or more scale forming species may be appropriate, depending upon the precise chemistry in a particular application. Therefore, in such an embodiment, when silica is present at about 200 parts per million (as $SiO_2$) in the selected substantially suspended solids free brine liquor, then dilution to a silica level of about 150 parts per million (as $SiO_2$) in the clear brine solution 270 is appropriate. In yet another embodiment, upon dilution, (and thus before injection) the silica level in clear brine solution 270 is about 30%, or further, from the level of silica in the substantially solids free brine liquor, or consequently, from the solubility limit of silica in clear brine solution 270. Similar dilution (i.e., 30%) for other of the one or more scale forming species may be appropriate, depending upon the precise chemistry in a particular application. Consequently, in such an embodiment, when silica is present at about 200 parts per million (as $SiO_2$) in the selected substantially suspended solids free brine liquor, then dilution to a silica level of about 140 parts per million (as $SiO_2$) in the clear brine solution 270 is appropriate. Further, the solubility limit as a function of temperature, especially as applicable to the anticipated downhole temperature at the second geological formation 281, should in most applications be accounted for when calculating the anticipated silica solubility limit, as the brine blowdown treatment process 232 should normally provide a clear brine solution 270 that may be injected into well 240 without fear of well plugging over time by deposition of scale from the solution 270 being injected.

While the effect of temperature was just noted with respect to silica, which is more soluble at higher temperature, it is important to note that the solubility of calcium sulfate is inversely soluble, so that as a clear brine solution 270 is cools for downhole injection, the cooling of the clear brine solution further aids in desaturation of the brine.

Further, it must be noted that a relatively small amount of distillate 180 may be utilized to achieve the advantageous results taught herein. For example if 1000 US gallons per minute of de-oiled produced water 46 is treated in a crystallizing evaporator 140, a brine blowdown stream 230 of only 10 US gallons per minute would be produced when operating at 100 cycles of concentration. In such a process situation, 990 US gallons per minute of distillate 180 would be produced for generation of downhole high pressure steam 70. Removal of suspended solids from the brine blowdown stream 230 as described herein produces a substantially solids free clear brine liquor, of approximately, but not quite 10 US gallons per minute. For purposes of example, however, if 10 US gallons per minute of distillate 180 is used for dilution by addition to 10 US gallons per minute of a substantially solids free clear brine liquor prepared by a suitable method such as one of those set forth herein, then overall, the clear brine solution 270 has a volume of 20 US gallons per minute.

Further, the degree of saturation of the scaling salts in the clear brine solution 270 is thus cut in half, when compared with dissolved solids level in the brine blowdown stream 230. Thus, in this typical example, the overall recovery of the crystallizing evaporator system 140 is decreased only from 99% to 98%. Thus, it can be seen that it may be advantageous to mix a substantially suspended solids free clear liquor derived from brine blowdown stream 230 in a 50-50 ratio with distillate 180, to achieve a suitable composition for a clear brine solution 270 for injection into a selected second geological formation 281.

Although only several exemplary embodiments of this invention have been described in detail, it will be readily apparent to those skilled in the art that the novel produced waste treatment process, and the apparatus for implementing the process, may be modified from the exact embodiments provided herein, without materially departing from the novel teachings and advantages provided by this invention, and may be embodied in other specific forms without departing from the spirit or essential characteristics thereof. Therefore, the disclosures presented herein are to be considered in all respects as illustrative and not restrictive. It will thus be seen that the objects set forth above, including those made apparent from the preceding description, are efficiently attained. Many other embodiments are also feasible to attain advantageous results utilizing the principles disclosed herein. Therefore, it will be understood that the foregoing description of representative embodiments of the invention have been presented only for purposes of illustration and for providing an understanding of the invention, and it is not intended to be exhaustive or restrictive, or to limit the invention only to the precise forms disclosed.

All of the features disclosed in this specification (including any accompanying claims, and the drawing) may be combined in any combination, except combinations where at least some of the features are mutually exclusive. Alternative features serving the same or similar purpose may replace each feature disclosed in this specification (including any accompanying claims, and the drawing), unless expressly stated otherwise. Thus, each feature disclosed is only one example of a generic series of equivalent or similar features. Further, while certain process steps are described for the purpose of enabling the reader to make and use certain water treatment processes shown, such suggestions shall not serve in any way to limit the claims to the exact variation disclosed, and it is to be understood that other variations, including various treatment additives or alkalinity removal techniques, may be utilized in the practice of my method.

The intention is to cover all modifications, equivalents, and alternatives falling within the scope and spirit of the invention, as expressed herein above and in any appended claims. The scope of the invention, as described herein and as indicated by any appended claims, is thus intended to include variations from the embodiments provided which are nevertheless described by the broad meaning and range properly afforded to the language of the claims, as explained by and in light of the terms included herein, or the legal equivalents thereof.

The invention claimed is:

1. A process to recover heavy hydrocarbon oil by in situ dissolution of at least a portion of a first geological formation containing quantities of heavy hydrocarbon oil, comprising:

injecting steam into the first geological formation to heat the heavy hydrocarbon oils in the first geological formation and to mobilize least a portion of said heavy hydrocarbon oils in the first geological formation, to produce a mixture of oil and produced water, wherein said produced water comprises condensate from said steam;

separating oil from said mixture of oil and produced water to provide (i) an oil product, and (ii) a produced water composition comprising water and oil;

de-oiling said produced water composition to at least partially provide an evaporator feedwater stream, said evaporator feedwater stream comprising water, dissolved gases, and dissolved solutes, said dissolved solutes comprising calcium, sulfate, and silica;

providing a crystallizing evaporator having a plurality of heat transfer elements, a liquid containing sump reservoir, and a recirculating pump to recycle liquid from said liquid containing sump reservoir into a heat transfer relationship with said plurality of heat transfer elements;

seeding said liquid containing sump reservoir with a selected quantity of calcium sulfate seed crystals, and forming a circulating brine comprising a slurry of water and calcium sulfate seed crystals, wherein said slurry is maintained at a preselected concentration for preferential precipitation of said calcium, said sulfate, and said silica in said evaporator feedwater stream to said calcium sulfate seed crystals rather than to said heat transfer surfaces of said crystallizing evaporator;

feeding the evaporator feedwater stream to the crystallizing evaporator, and producing (i) a distillate stream, and (ii) a concentrated blowdown brine slurry stream comprising water, dissolved solids, said dissolved solids comprising silica, and suspended solids, said suspended solids comprising calcium sulfate and silica;

feeding said distillate stream to a boiler, and producing steam for injection into said first geological formation;

removing said suspended solids from said concentrated blowdown brine slurry stream to produce a substantially suspended solids free clear brine liquor.

2. The process as set forth in claim 1, further comprising injecting said substantially solids free clear brine liquor into a second geological formation, thereby providing disposal of said substantially solids free clear brine liquor.

3. The process as set forth in claim 1, further comprising diluting said substantially suspended solids free clear brine liquor with an aqueous diluent to produce a clear brine solution, said clear brine solution comprising water and dissolved solids, said dissolved solids comprising silica at a level of at about 10% or more below the level of silica in said substantially solids free clear brine liquor; and injecting said clear brine solution into a second geological formation, thereby providing disposal of said clear brine solution.

4. The process as set forth in claim 1, further comprising diluting said substantially suspended solids free clear brine liquor with an aqueous diluent to produce a clear brine solution, said clear brine solution comprising water and dissolved solids, said dissolved solids comprising silica at a level of at about 20% or more below the level of silica in said substantially solids free clear brine liquor; and injecting said clear brine solution into a second geological formation, thereby providing disposal of said clear brine solution.

5. The process as set forth in claim 1, further comprising diluting said substantially suspended solids free clear brine liquor with an aqueous diluent to produce a clear brine solution, said clear brine solution comprising water and dissolved solids, said dissolved solids comprising silica at a level of at about 25% or more below the level of silica in said substantially solids free clear brine liquor; and injecting said clear brine solution into a second geological formation, thereby providing disposal of said clear brine solution.

6. The process as set forth in claim 1, further comprising diluting said substantially suspended solids free clear brine liquor with an aqueous diluent to produce a clear brine solution, said clear brine solution comprising water and dissolved solids, said dissolved solids comprising silica at a level of at about 30% or more below the level of silica in said substantially solids free clear brine liquor; and injecting said clear brine solution into a second geological formation, thereby providing disposal of said clear brine solution.

7. A process to recover heavy hydrocarbon oil by in situ dissolution of at least a portion of a first geological formation containing quantities of heavy hydrocarbon oil, comprising:

injecting steam into the first geological formation to heat the heavy hydrocarbon oils in the first geological formation and to mobilize least a portion of said heavy hydrocarbon oils in the first geological formation, to produce a mixture of oil and produced water, wherein said produced water comprises condensate from said steam;

separating oil from said mixture of oil and produced water to provide (i) an oil product, and (ii) a produced water composition comprising water and oil;

de-oiling said produced water composition to at least partially provide an evaporator feedwater stream, said evaporator feedwater stream comprising water, dissolved gases, and dissolved solutes, said dissolved solutes comprising calcium, sulfate, and silica;

providing a crystallizing evaporator having a plurality of heat transfer elements, a liquid containing sump reservoir, and a recirculating pump to recycle liquid from said liquid containing sump reservoir into a heat transfer relationship with said plurality of heat transfer elements;

seeding said liquid containing sump reservoir with a selected quantity of calcium sulfate seed crystals, and forming a circulating brine comprising a slurry of water and calcium sulfate seed crystals, wherein said slurry is maintained at a preselected concentration for preferential precipitation of said calcium, said sulfate, and said silica in said evaporator feedwater stream to said calcium sulfate seed crystals rather than to said heat transfer surfaces of said crystallizing evaporator;

feeding the evaporator feedwater stream to the crystallizing evaporator, and producing (i) a distillate stream, and (ii) a concentrated blowdown brine slurry stream comprising water, dissolved solids, said dissolved solids comprising one or more scale forming species, and suspended solids, said suspended solids comprising calcium sulfate and silica;

feeding said distillate stream to a boiler, and producing steam for injection into said first geological formation;

removing said suspended solids from said concentrated blowdown brine slurry stream to produce a substantially suspended solids free clear brine liquor;

diluting said substantially suspended solids free clear brine liquor with an aqueous diluent to produce a clear brine solution, said clear brine solution comprising water and dissolved solids, said dissolved solids comprising scale forming species at a level of at about 10% or more below the level of said one or more scale forming species in said substantially solids free clear brine liquor; and injecting said clear brine solution into a second geological formation, thereby providing disposal of said clear brine solution.

8. The process as set forth in claim 7, wherein said one or more scale forming species comprises silica.

9. The process as set forth in claim 7, wherein said one or more scale forming species comprises calcium.

10. The process as set forth in claim 7, wherein said one or more scale forming species comprises barium.

11. The process as set forth in claim 7, wherein said one or more scale forming species comprises strontium.

12. The process as set forth in claim 7, wherein said one or more scale forming species comprises sulfate.

13. The process as set forth in claim 7, wherein said dissolved solids comprising one or more scale forming species are present in said clear brine solution at a level of at about 20% or more below the level of said scale forming species in said substantially solids free clear brine liquor.

14. The process as set forth in claim 7, wherein said dissolved solids comprising one or more scale forming species are present in said clear brine solution at a level of at about 25% or more below the level of said scale forming species in said substantially solids free clear brine liquor.

15. The process as set forth in claim 7, wherein said dissolved solids comprising one or more scale forming species are present in said clear brine solution at a level of at about 30% or more below the level of said scale forming species in said substantially solids free clear brine liquor.

16. A process for treatment of waste brines produced during steam generation operations associated with the recovery of heavy hydrocarbon oil by in situ dissolution of at least a portion of a first geological formation containing quantities of heavy hydrocarbon oil, said process comprising:

injecting steam into the first geological formation to heat the heavy hydrocarbon oils in the first geological formation and to mobilize least a portion of said hydrocarbon oils in the first geological formation, to produce a mixture of oil and produced water, wherein said produced water comprises condensate from said steam;

separating oil from said mixture of oil and produced water to provide (i) an oil product, and (ii) a produced water composition comprising water and oil;

de-oiling said produced water composition to at least partially provide an evaporator feedwater stream, said evaporator feedwater stream comprising water, dissolved gases, and dissolved solutes, said dissolved solutes comprising calcium, sulfate, and silica;

providing a crystallizing vapor recompression evaporator having a plurality of heat transfer elements, a liquid containing sump reservoir, and a recirculating pump to recycle liquid from said liquid containing sump reservoir into a heat transfer relationship with said plurality of heat transfer elements;

seeding said liquid containing sump reservoir with a selected quantity of calcium sulfate seed crystals, and forming a circulating brine comprising a slurry of water and calcium sulfate seed crystals, wherein said slurry is maintained at a preselected concentration for preferential precipitation of said calcium, said sulfate, and said silica to said calcium sulfate seed crystals rather than to said heat transfer surfaces of said crystallizing evaporator;

acidifying said evaporator feedwater stream, to convert non-hydroxide alkalinity to carbon dioxide;

steam stripping said acidified evaporator feedwater stream, and removing said non-condensable gases and said carbon dioxide;

feeding the acidified and steam stripped evaporator feedwater stream to the crystallizing evaporator, and producing (i) a distillate stream, and (ii) a concentrated blowdown brine slurry stream comprising water, dissolved solids, and suspended solids, said suspended solids comprising calcium sulfate and silica;

feeding at least some of said distillate stream to a boiler, and producing high pressure steam for injection into said first geologic formation;

removing said suspended solids from said concentrated blowdown brine slurry stream to produce a substantially suspended solids free clear brine liquor;

diluting said substantially suspended solids free clear brine liquor with at least a portion of said distillate stream to produce a clear brine solution, said clear brine solution comprising water and dissolved solids, said dissolved solids comprising silica at a level of below the level of silica in said clear brine solution;

injecting said clear brine solution into a second geological formation, thereby providing disposal of said clear brine solution.

17. The process as set forth in claim 3, or in claim 7, or in claim 16, wherein said substantially suspended solids free clear brine liquor comprises about 200 parts per million or more of silica, as $SiO_2$ and wherein said clear brine solution comprises about 180 ppm or less of silica.

18. The process as set forth in claim 4, or in claim 7, or in claim 16, wherein said substantially suspended solids free clear brine liquor comprises about 200 parts per million or more of silica, as $SiO_2$ and wherein said clear brine solution comprises about 160 ppm or less of silica.

19. The process as set forth in claim 5, or in claim 7, or in claim 16, wherein said substantially suspended solids free clear brine liquor comprises about 200 parts per million or more of silica, as $SiO_2$ and wherein said clear brine solution comprises about 150 ppm or less of silica.

20. The process as set forth in claim 6, or in claim 7, or in claim 16, wherein said substantially suspended solids free clear brine liquor comprises about 200 parts per million or more of silica, as $SiO_2$ and wherein said clear brine solution comprises about 140 ppm or less of silica.

21. The process as set forth in claim 1, or claim 7, or claim 16, wherein removal of said suspended solids from said concentrated blowdown brine slurry stream to produce said substantially suspended solids free clear brine liquor comprises centrifuging said concentrated blowdown brine slurry stream.

22. The process as set forth in claim 1, or claim 7, or claim 16, wherein removal of said suspended solids from said concentrated blowdown brine slurry stream to produce said substantially suspended solids free clear brine liquor comprises filtering said concentrated blowdown brine slurry stream in a filter press.

23. The process as set forth in claim 22, wherein said filter comprises a pressure filter.

24. The process as set forth in claim 1, or claim 7, or claim 16, wherein removal of said suspended solids from said concentrated blowdown brine slurry stream to produce said substantially suspended solids free clear brine liquor comprises processing said concentrated blowdown brine slurry in a clarifier, to settle solids from said concentrated blowdown brine slurry stream.

25. The process as set forth in claim 1, or claim 7, or claim 16, wherein removal of said suspended solids from said concentrated blowdown brine slurry stream to produce said substantially suspended solids free clear brine liquor comprises processing said concentrated blowdown brine slurry in one or more hydrocyclones, to settle solids from said concentrated blowdown brine slurry stream.

26. The process as set forth in claim 1, or claim 7, or claim 16, wherein said evaporator is a falling-film evaporator.

27. The process as set forth in claim 1, or claim 7, or claim 16, wherein said evaporator is a forced-circulation evaporator.

28. The process as set forth in claim 26, wherein said heat transfer elements are tubular elements having an interior surface and an exterior surface.

29. The process as set forth in claim 28, wherein said evaporator feedwater stream is concentrated at the interior surface of said tubular heat transfer elements.

30. The process as set forth in claim 1, or claim 7, or claim 16, wherein said evaporator comprises a mechanical vapor recompression evaporator.

31. The process as set forth in claim 1, or claim 7, or claim 16, further comprising removing oil from said evaporator feedwater stream to a selected oil concentration before injecting said evaporator feedwater stream into said evaporator.

32. The process as set forth in claim 31, wherein the selected concentration of oil in said evaporator feedwater stream comprises less than about twenty parts per million.

33. The process as set forth in claim 1, or claim 7, or claim 16, wherein said boiler comprises a packaged boiler.

34. The process as set forth in claim 33, wherein said packaged boiler comprises a water tube boiler.

35. The process as set forth in claim 1, or claim 7, or claim 16, wherein said boiler comprises a once-through steam generator.

36. The process as set forth in claim 35, further comprising, after generating steam in said once through steam generator, separating steam and liquid, to produce a steam stream having substantially 100% steam quality.

37. The process as set forth in claim 36, wherein said 100% steam quality steam stream is injected into said first geological formation.

38. The process as set forth in claim 36, wherein separating said steam and said liquid comprises producing a liquid stream containing dissolved solutes, and wherein said liquid stream is flashed at least once to produce a still further concentrated residual liquid containing dissolved solutes.

39. The process as set forth in claim 38, further comprising adding said residual liquid stream containing dissolved solutes to said evaporator feedwater stream.

40. The process as set forth in claim 1, or claim 7, or claim 16, wherein said distillate stream comprises water and non-volatile solutes, said non-volatile salutes present in the range of from about zero to about 20 parts per million.

41. The process as set forth in claim 1, or claim 7, or claim 16, further comprising acidification of said evaporator feedwater stream, to convert non-hydroxide alkalinity to carbon dioxide.

42. The process as set forth in claim 41, further comprising steam stripping said acidified evaporator feedwater stream, and removing said non-condensable gases and said carbon dioxide.

43. The process as set forth in claim 1, or claim 7, or claim 16, wherein said distillate stream comprises about 95% or more by volume of said evaporator feedwater stream,

44. The process as set forth in claim 43, wherein said concentrated blowdown brine slurry stream comprising about 5% or less by volume of said evaporator feedwater stream.

45. The process as set forth in claim 1, or claim 7, or claim 16, wherein producing steam in a boiler comprises generating a steam stream at about 100% quality and at about 1000 pounds per square inch pressure or more from said distillate stream, and wherein said steam stream comprises at least about 70% by weight of said distillate stream.

46. The process as set forth in claim 45, wherein said steam stream comprises at least 95% by weight of said distillate stream.

47. The process as set forth in claim 45, wherein said steam stream comprises at least 98% by weight of said distillate stream.

48. The process as set forth in claim 7, or in claim 16, wherein said aqueous diluent comprises a portion of said distillate stream from said crystallizing evaporator.

49. The process as set forth in claim 7, or in claim 16, wherein said aqueous diluent comprises service water.

50. The process as set forth in claim 7, or in claim 16, wherein diluting said substantially suspended solids free clear brine liquor with at least a portion of said distillate stream to produce a clear brine solution comprises mixing a portion of said distillate stream with said substantially suspended solids free clear brine liquor at a ratio of about 50% by volume of portions from said distillate stream and of said substantially suspended solids free clear brine liquor.

* * * * *

UNITED STATES PATENT AND TRADEMARK OFFICE

CERTIFICATE OF CORRECTION

PATENT NO. : 7,681,643 B2
APPLICATION NO. : 11/534627
DATED : March 23, 2010
INVENTOR(S) : William F. Heins It is certified that error appears in the above-identified patent and that said Letters Patent is hereby corrected as shown below:

Column 8, line 58, after the words "or appropriate," insert --to--.

Column 8, line 58, after the word "run", delete "to utilize".

Column 9, line 39, delete "elimination" and substitute therefore --eliminating--.

Column 9, line 40, after the words "waste streams,", insert --and--.

Column 14, line 47, after the words "solution 270 is", delete "cools" and substitute therefore --cooled--.

Column 20, line 45, after the words "said non-volatile", delete "salutes" and substitute therefore --solutes--.

Column 20, line 57, after the words "feedwater stream", delete "," and substitute therefore --.--.

Signed and Sealed this

Fourteenth Day of December, 2010

David J. Kappos

David J. Kappos
*Director of the United States Patent and Trademark Office*